US011180337B2

(12) United States Patent
Kaiga et al.

(10) Patent No.: US 11,180,337 B2
(45) Date of Patent: Nov. 23, 2021

(54) SHEET DISCHARGE APPARATUS AND IMAGE FORMING APPARATUS

(71) Applicant: CANON KABUSHIKI KAISHA, Tokyo (JP)

(72) Inventors: Miho Kaiga, Suntou-gun (JP); Yohei Suzuki, Mishima (JP); Junichi Ochi, Mishima (JP); Kazuhide Okuno, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 179 days.

(21) Appl. No.: 16/413,748

(22) Filed: May 16, 2019

(65) Prior Publication Data

US 2019/0367313 A1 Dec. 5, 2019

(30) Foreign Application Priority Data

May 31, 2018 (JP) ..... JP2018-105567

(51) Int. Cl.

| | |
|---|---|
| ***B65H 43/06*** | (2006.01) |
| ***B65H 43/08*** | (2006.01) |
| ***B65H 29/14*** | (2006.01) |
| ***B65H 29/44*** | (2006.01) |

(52) U.S. Cl.

CPC ..... *B65H 29/44* (2013.01); *B65H 29/14* (2013.01); *B65H 43/08* (2013.01)

(58) Field of Classification Search

CPC .... B65H 43/06; B65H 43/08; B65H 2553/51; B65H 2553/612; B65H 2513/50; B65H 2513/511; B65H 2513/512; B65H 2511/152; B65H 2511/214; B65H 29/14; B65H 2601/271

See application file for complete search history.

(56) References Cited

U.S. PATENT DOCUMENTS

| | | | |
|---|---|---|---|
| 6,113,093 A | 9/2000 | Morinaga et al. | |
| 6,564,966 B2 | 5/2003 | Kaiga et al. | |
| 7,976,018 B2 * | 7/2011 | Ueda | B65H 43/08 271/207 |

(Continued)

FOREIGN PATENT DOCUMENTS

| | | |
|---|---|---|
| JP | 2001-106426 A | 4/2001 |
| JP | 2016-069146 A | 5/2016 |
| JP | 2017-078815 A | 4/2017 |

*Primary Examiner* — Luis A Gonzalez

(74) *Attorney, Agent, or Firm* — Venable LLP

(57) ABSTRACT

A sheet discharge apparatus includes a pivot member pivoting in an up-down direction by being pressed by a sheet discharged from a sheet discharging portion, with the pivot member retained by being in contact with an uppermost sheet supported on the sheet supporting portion. A control unit changes a sheet interval between a preceding sheet and a succeeding sheet and executes a first discharge operation in which at least one sheet is discharged, and a second discharge operation in which sheets are discharged by the sheet discharging portion at a first sheet interval such that the pivot member does not contact with an uppermost sheet supported on the sheet supporting portion during the second discharge operation, and the control unit acquires a number of sheets to be discharged in the second discharge operation based on a detected position of the pivot member detected during the first discharge operation.

23 Claims, 18 Drawing Sheets

(56) References Cited

U.S. PATENT DOCUMENTS

| | | | | |
|---|---|---|---|---|
| 8,632,155 | B2 * | 1/2014 | Ueno | B65H 7/18 347/16 |
| 8,864,128 | B2 * | 10/2014 | Miyajima | B65H 31/02 271/176 |
| 9,266,696 | B2 * | 2/2016 | Ogawa | B65H 31/02 |
| 9,280,101 | B2 | 3/2016 | Koyama et al. | |
| 9,400,462 | B2 | 7/2016 | Koyama et al. | |
| 9,904,222 | B2 | 2/2018 | Koyama et al. | |
| 2018/0136595 | A1 | 5/2018 | Koyama et al. | |

* cited by examiner

SHEET DISCHARGE APPARATUS AND IMAGE FORMING APPARATUS

BACKGROUND OF THE INVENTION

Field of the Invention

The present invention relates to a sheet discharge apparatus that discharges sheets and an image forming apparatus equipped with the same.

Description of the Related Art

In general, image forming apparatuses such as printers, copying machines and facsimiles are equipped with a sheet supporting portion that discharges sheets on which images are formed and supports the discharged sheets. An image forming apparatus capable of detecting a full load status of sheets supported on the sheet supporting portion is proposed (refer to Japanese Patent Application Laid-Open Publication No. 2001-106426). Japanese Patent Application Laid-Open Publication No. 2001-106426 discloses an image forming apparatus including a sensor that detects a full load status and a flag member. The sensor continuously outputs an ON signal in a state where a tip portion of a flag member contacts an uppermost sheet on the bundle of sheets in full load status supported on the sheet supporting portion, by which the full load status is detected.

Recently, from a viewpoint of further improvement of productivity of the image forming apparatus, that is, for increasing the number of sheets on which an image is formed per unit time, there are demands to further shorten an interval between sheets that are continuously conveyed in a state where a plurality of sheets are conveyed continuously.

However, in the image forming apparatus disclosed in Japanese Patent Application Laid-Open Publication No. 2001-106426, a problem occurs if the interval between continuous sheets during continuous conveyance of a plurality of sheets is shortened from the viewpoint of further enhancement of productivity of the image forming apparatus. Specifically, if the interval between continuously conveyed sheets is set to a predetermined distance or shorter, while the flag member is being pushed up during discharge of the first sheet, the second and subsequent sheets will be discharged continuously. In other words, the sensor signal is turned on when discharge of the first sheet is started, and even when the discharge of the first sheet is completed, the sensor signal will continue to be turned on and will not be switched off. In that case, according to the sensor of the image forming apparatus disclosed in Japanese Patent Application Laid-Open Publication No. 2001-106426, even if the sheets loaded on the sheet supporting portion has not actually reached a full load status, the sensor erroneously detects the full load status and the image forming operation is stopped. As described, according to the image forming apparatus taught in Japanese Patent Application Laid-Open Publication No. 2001-106426, if continuous conveyance of sheets is performed at a shortened sheet interval, there is a drawback in that the image forming operation is stopped before the full load status, and that productivity is contrarily deteriorated.

SUMMARY OF THE INVENTION

According to a first aspect of the present invention, a sheet discharge apparatus includes a sheet discharging portion configured to discharge a sheet, a sheet supporting portion configured to support the sheet discharged from the sheet discharging portion, a pivot member configured to pivot in an up-down direction around a pivot axis by being pressed by the sheet discharged from the sheet discharging portion, the pivot member being retained by being in contact with an uppermost sheet supported on the sheet supporting portion, a detecting unit configured to detect a position of the pivot member, and a control unit configured to change a sheet interval which is an interval between a preceding sheet and a succeeding sheet, wherein, in a state where a job in which a plurality of sheets are to be continuously discharged is received, the control unit executes a first discharge operation in which at least one sheet is discharged by the sheet discharging portion, a second discharge operation in which sheets are discharged by the sheet discharging portion at a first sheet interval, and a third discharge operation in which at least one sheet is discharged by the sheet discharge portion at a second sheet interval that is longer than the first sheet interval, a number of sheets discharged in the second discharge operation being acquired based on a detection result of the detecting unit detected during the first discharge operation.

According to a another aspect of the present invention, an image forming apparatus includes a sheet discharging portion configured to discharge a sheet, a sheet supporting portion configured to support the sheet discharged from the sheet discharging portion, a pivot member configured to pivot in an up-down direction around a pivot axis by being pressed by the sheet discharged from the sheet discharging portion, the pivot member being retained by being in contact with an uppermost sheet supported on the sheet supporting portion, a detecting unit configured to detect a position of the pivot member, and a control unit configured to change a sheet interval which is an interval between a preceding sheet and a succeeding sheet, wherein, in a state where a job in which a plurality of sheets are to be continuously discharged is received, the control unit executes a first discharge operation in which at least one sheet is discharged by the sheet discharging portion, a second discharge operation in which sheets are discharged by the sheet discharging portion at a first sheet interval, and a third discharge operation in which at least one sheet is discharged by the sheet discharge portion at a second sheet interval that is longer than the first sheet interval, a number of sheets discharged in the second discharge operation being acquired based on a detection result of the detecting unit detected during the first discharge operation.

Further features of the present invention will become apparent from the following description of exemplary embodiments with reference to the attached drawings.

DESCRIPTION OF THE EMBODIMENTS

First Embodiment

General Arrangement

Figure 1:
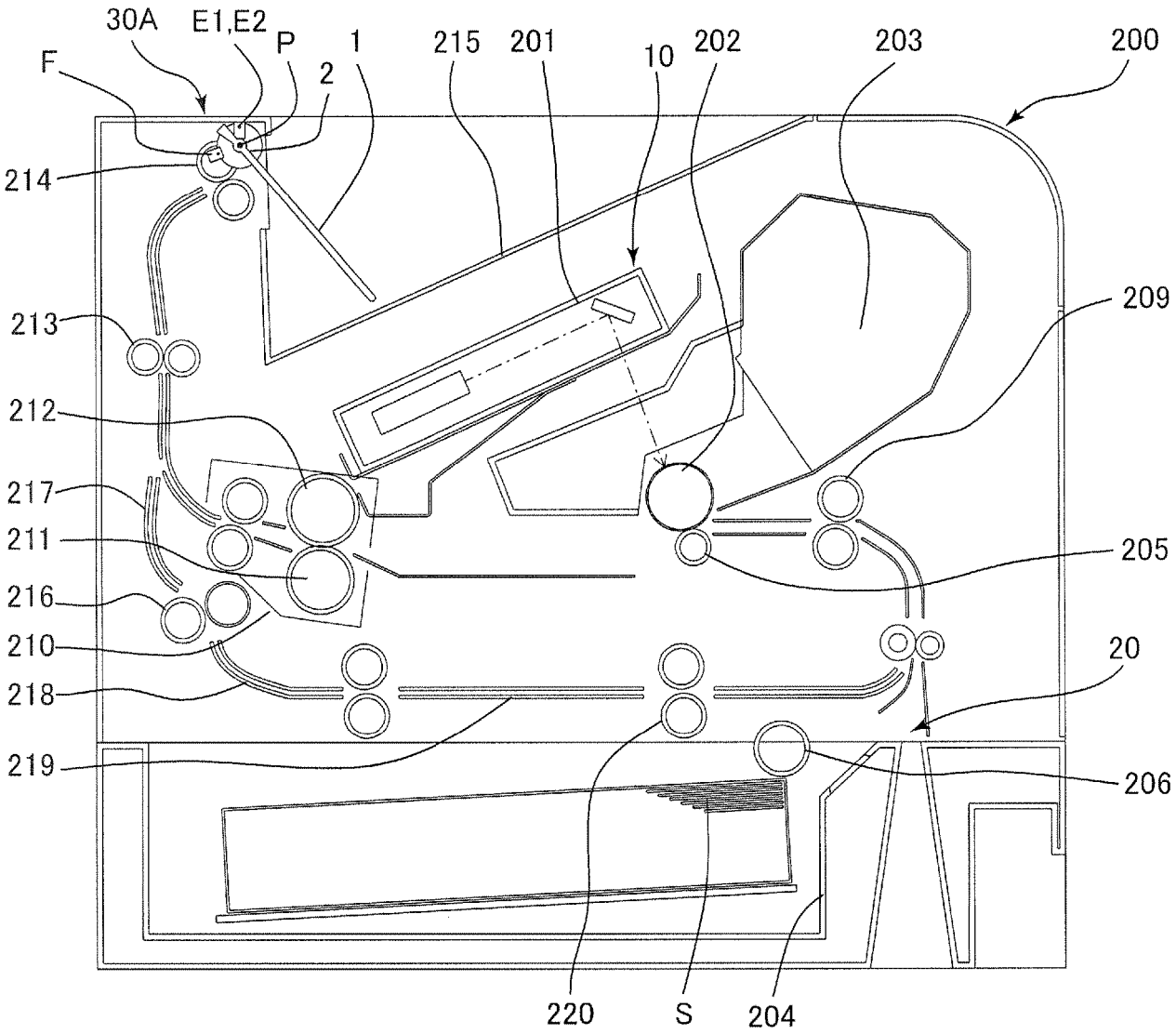
FIG. 1 is a general schematic diagram illustrating a printer according to a first embodiment.

A first embodiment of the present invention will be described with reference to the accompanying drawings. FIG. 1 is a schematic drawing illustrating a printer 200 serving as an image forming apparatus according to the first embodiment viewed from a front side. In the following description, directions including up, down, left, right, front and rear are described based on a state in which the printer 200 is viewed approximately from a front side, that is, from the viewpoint of FIG. 1. The printer 200 is a laser beam printer adopting an electrophotographic system. As illustrated in FIG. 1, the printer 200 includes an image forming unit 10 configured to form an image on a sheet S, a sheet feeding unit 20 for feeding sheets S to the image forming unit 10, and a sheet discharge apparatus 30A for discharging the sheet S on which the image has been formed in the image forming unit 10 to an exterior.

The image forming unit 10 includes an optical unit 201, a photosensitive drum 202, a developing unit 203, a transfer roller 205 and a fixing unit 210. If the image forming unit 10 receives a command to start the image forming operation, the photosensitive drum 202 serving as the photosensitive member rotates, and the surface of the photosensitive drum 202 is charged uniformly by a charging unit not shown. Then, the optical unit 201 modulates and outputs laser beams based on image data entered from an input interface or an external computer not shown. In a state where the optical unit 201 outputs laser beams and scans the surface of the photosensitive drum 202, an electrostatic latent image based on image data is formed on the surface of the photosensitive drum 202. The electrostatic latent image formed on the surface of the photosensitive drum 202 is visualized by toner supplied from the developing unit 203 and is formed as a toner image.

In parallel with this image forming operation, the sheet feeding unit 20 feeds a sheet S loaded on a cassette 204 arranged on a lower portion of the printer 200 toward the image forming unit 10. In the sheet feeding unit 20, at first, an uppermost sheet S loaded on the cassette 204 is sent out by a pickup roller 206. The sheet S sent out from the cassette 204 by the pickup roller 206 is transferred to a conveyance roller pair 209, and then conveyed to the image forming unit 10 at a synchronized timing with the toner image borne on the photosensitive drum 202. The toner image borne on the photosensitive drum 202 is transferred onto the sheet S by the transfer roller 205. The sheet S onto which toner image has been transferred is subjected to heat and pressure at the fixing unit 210, by which the toner image transferred to the sheet S is fixed. The sheet S onto which toner image has been fixed is conveyed to an intermediate sheet discharge roller pair 213.

Now, if the job entered to the printer 200 is a job for printing to one side, that is, a first side, of the sheet S, the sheet S to which toner image has been fixed on the first side is conveyed by the intermediate sheet discharge roller pair 213 to the sheet discharge apparatus 30A. The sheet discharge apparatus 30A discharges the sheet S conveyed from the intermediate sheet discharge roller pair 213 onto a sheet discharge tray 215 serving as a sheet supporting portion. Meanwhile, if the job entered to the printer 200 is a job to print images on both sides, that is, to the first side and a second side of the sheet S, the intermediate sheet discharge roller pair 213 rotates in an opposite direction while nipping the sheet. The sheet S conveyed to a re-conveyance path 217 by the intermediate sheet discharge roller pair 213 is guided by a switchback roller pair 216 and the like from the re-conveyance path 217 to a duplex printing conveyance path 218. The sheet S guided to the duplex printing conveyance path 218 is temporarily placed on an intermediate tray 219 in the duplex printing conveyance path 218. The sheet S temporarily placed on the intermediate tray 219 is conveyed again to the image forming unit 10 by a re-conveyance roller pair 220 at a synchronized timing with the toner image borne on the photosensitive drum 202. Thereafter, similarly as the case where the job entered to the printer 200 is a job for printing an image to one side of the sheet S, the sheet S on which toner images have been fixed to both sides is discharged to the sheet discharge tray 215.

Discharge Apparatus

Figure 2:
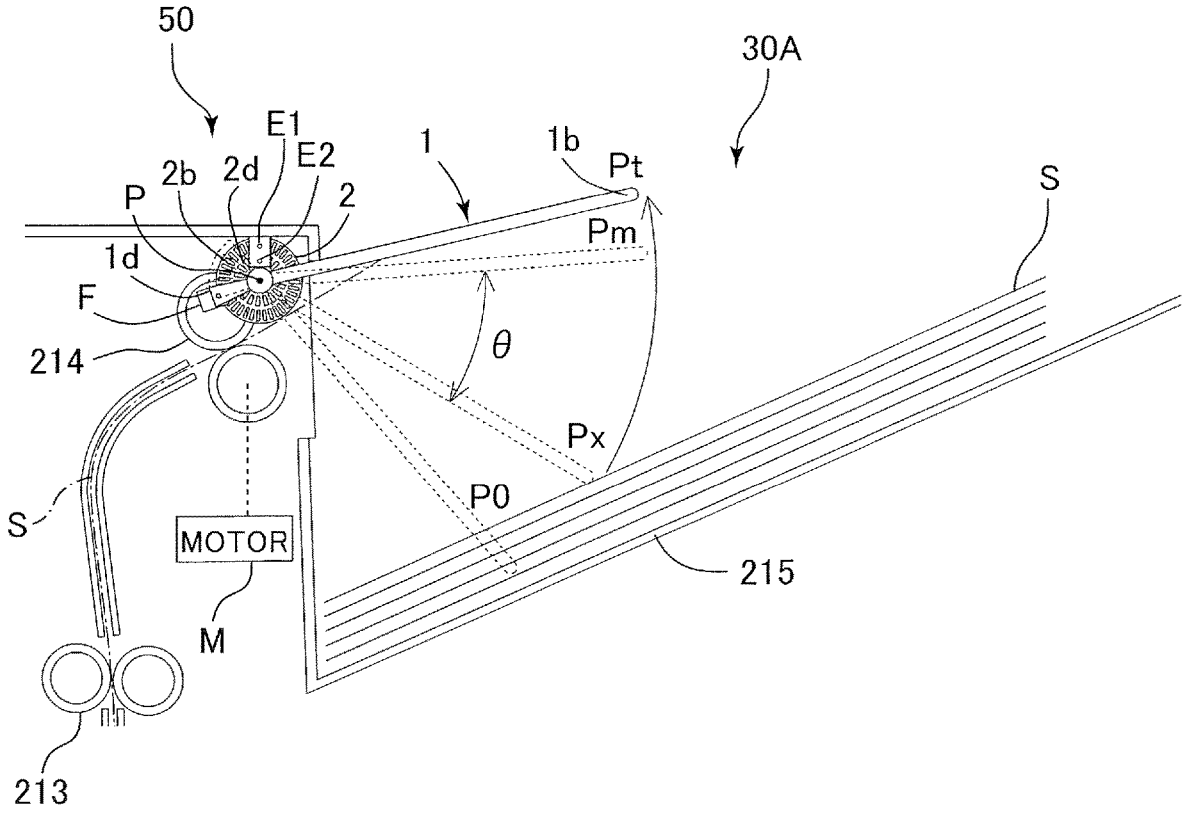
FIG. 2 is a cross-sectional view illustrating a sheet discharge apparatus.
Figure 3:
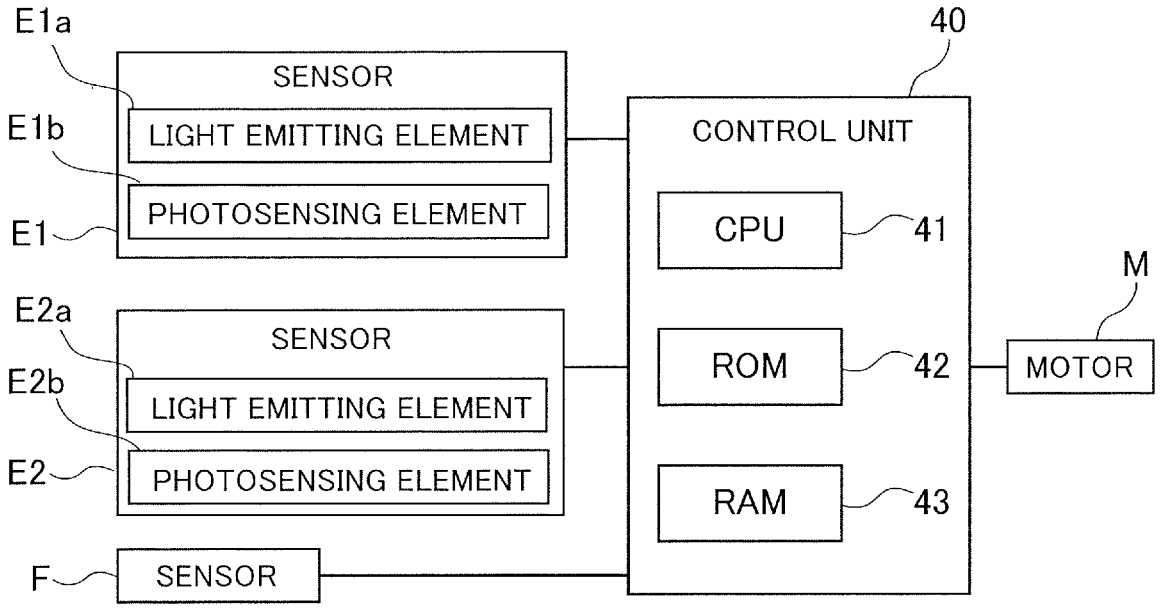
FIG. 3 is a block diagram illustrating a control unit.

Next, the sheet discharge apparatus 30A will be described. The sheet discharge apparatus 30A includes, as illustrated in FIG. 2, a sheet discharge roller pair 214, the sheet discharge tray 215, a flag 1 serving as a pivot member, a pivot disk 2, a sensor E1 and a sensor E2, and a sensor F serving as a target position detecting portion. The pivot disk 2 and sensors E1, E2 and F constitute a detecting unit 50 for detecting the pivot angle of the flag 1. Further, a motor M serving as a driving source for rotating or stopping rotation of the sheet discharge roller pair 214 is provided in the sheet discharge apparatus 30A. Further, the sheet discharge apparatus 30A is equipped with a control unit 40 (FIG. 3).

Figure 4A:
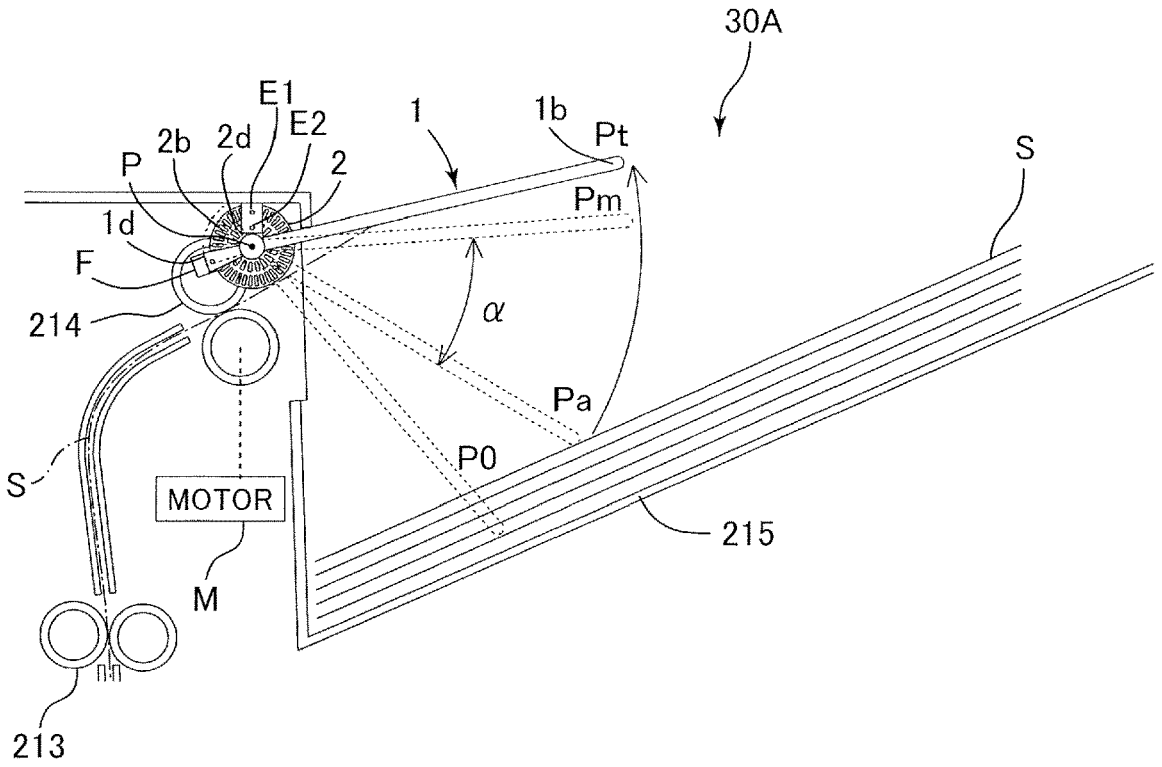
FIG. 4A is a cross-sectional view illustrating an operation outline of the sheet discharge apparatus in a case where an amount of sheet load is in a small-loaded state.
Figure 5A:
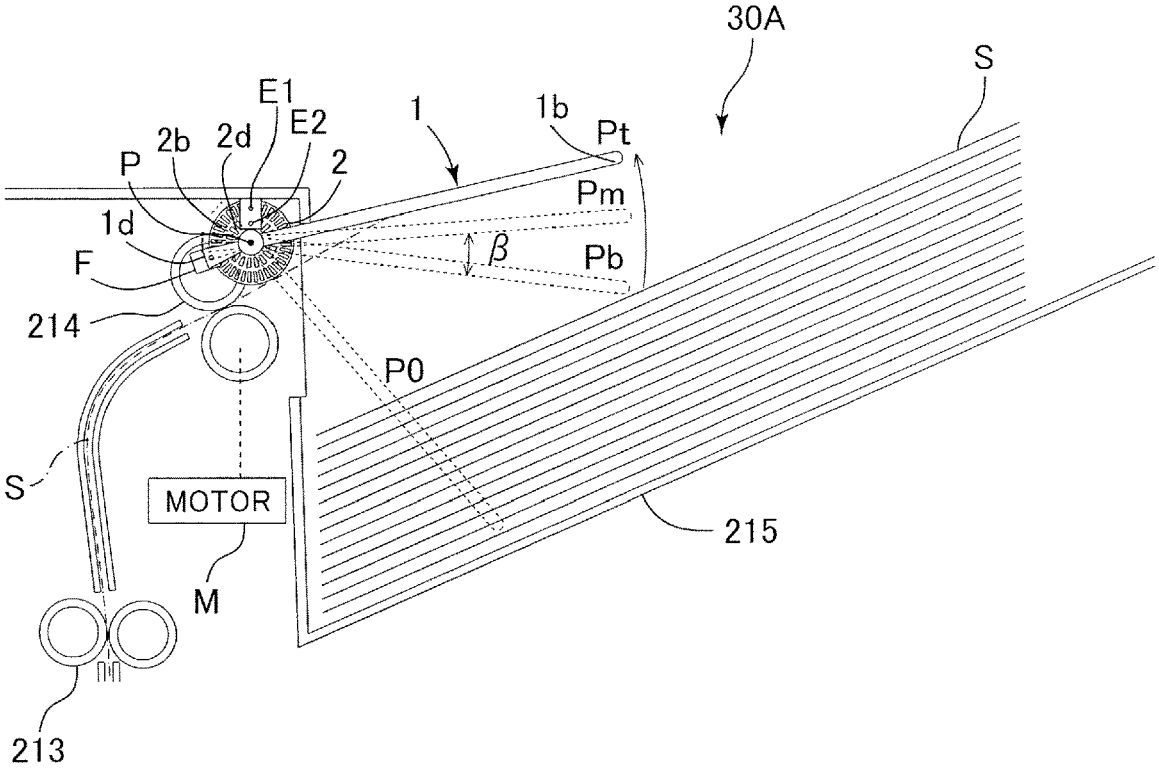
FIG. 5A is a cross-sectional view illustrating an operation outline of a sheet discharge apparatus in a case where the amount of sheet load is in a middle-loaded state.
Figure 5B:
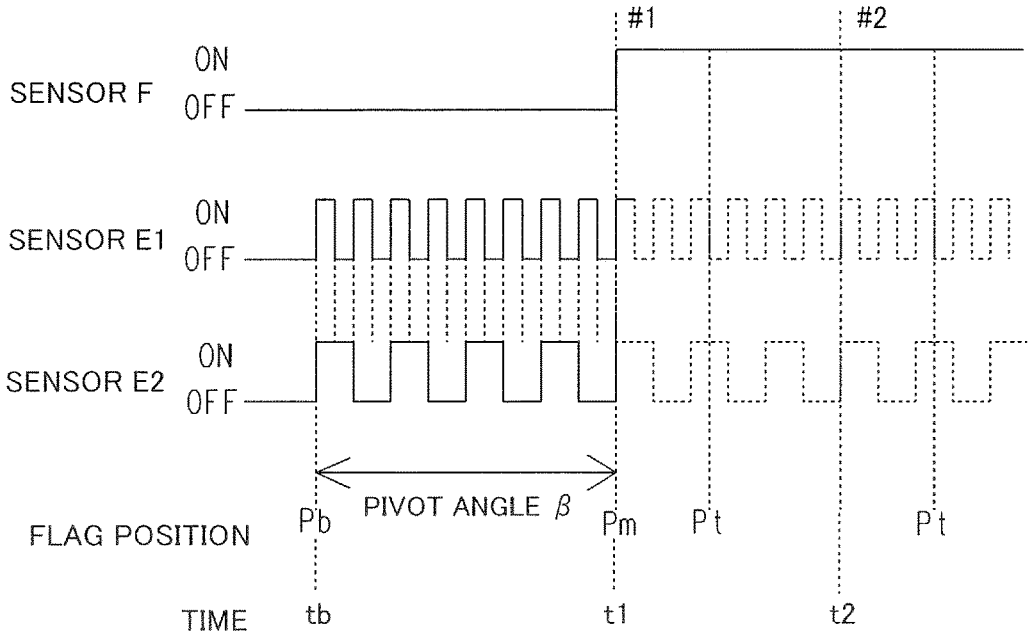
FIG. 5B is a view illustrating an example of a signal waveform that the respective sensors output in a case where the amount of sheet load is in a middle-loaded state.

The flag 1 is a bar-shaped member arranged pivotably in up-down directions around a pivot axis P at a position downstream in a conveyance direction of the sheet S of the sheet discharge roller pair 214 serving as the sheet discharging portion. The pivot axis P is arranged close to a base portion 1*d* than a tip portion 1*b* of the flag 1, that is, the base portion 1*d* is arranged at an opposite side of the tip portion 1*b* interposing the pivot axis P. The tip portion 1*b* serving as a first end portion is arranged above the sheet discharge tray 215. The flag 1 is pivotable in an up-down direction and a height direction within a range from a lowermost position P0 to an uppermost position Pt. A contact position Px illustrated in FIG. 2 is a position of the flag 1 in a state where the tip portion 1*b* is in contact with the uppermost sheet S among the sheets S loaded on the sheet discharge tray 215 in a state where a job to discharge the sheet S is received. The contact position Px has generalized, for example, the contact positions Pa and Pb illustrated in FIGS. 4A and 5B, and the flag 1 is retained at the contact position Px by being in contact with the uppermost sheet S on the sheet discharge tray 215. A pivot angle θ illustrated in FIG. 2 is a pivot angle of the flag 1 in a state where the flag 1 pivots between the contact position Px and a full load detection position Pm, and it has generalized pivot angles α and β, as illustrated in FIGS. 4A and 5B, for example.

The pivot disk 2 is arranged coaxially with the flag 1, and the pivot disk 2 can pivot around the pivot axis P integrally with the flag 1. A plurality of slits 2*b* and a plurality of slits 2*d* are formed on the pivot disk 2 along the pivoting direction. The respective distances from the pivot axis P to the slits 2*b* and 2*d* differ, and the slits 2*b* and 2*d* are arranged at different positions in the radial direction of the pivot disk 2. That is, the plurality of slits 2*b* disposed along the pivoting direction of the pivot disk 2 constitute a first row of slits, and the plurality of slits 2*d* disposed along the pivoting direction of the pivot disk 2 constitute a second row of slits. The number of the slits 2*b* and 2*d* are determined with consideration on the detection accuracy. Greater number of the plurality of slits 2*b* and 2*d* realize higher detection accuracy. The widths of the slits 2*b* and the slits 2*d* differ, in other words, the slits 2*b* and 2*d* are designed to have different resolving powers, and the pivoting direction of the flag 1 can be distinguished by the combination thereof. The pivot disk 2 and the sensors E1 and E2 constitute a pivotal quantity detecting portion for detecting a pivotal quantity of the flag 1.

The sensor E1 is arranged at a position capable of detecting light that passes through the slits 2*b*, such as at a position opposed to the slits 2*b* formed on the pivot disk 2. Further, the sensor E2 similar to the sensor E1 is arranged at a position capable of detecting light that passes through the slits 2*d*, such as at a position opposed to the slits 2*d*. The sensor E1 includes a photosensing element E1*b* serving as a first photosensing element that receives light emitted from a light emitting element E1*a* and having passed through any one of the slits 2*b* (refer to FIG. 3). Further, the sensor E2 includes a photosensing element E2*b* serving as a second photosensing element that receives light emitted from a light emitting element E2*a* and having passed through any one of the slits 2*d* (refer to FIG. 3). The sensors E1 and E2 can also be designed to detect reflected light reflected by the pivot disk 2 at a position where slits 2*b* and 2*d* are not disposed, instead of detecting the light having passed through the slits 2*b* and 2*d*.

Further, the sensor F is formed of an optical sensor similar to the sensors E1 and E2, for example, and detects a base portion 1*d* serving as a second end portion of the flag 1 positioned at a predetermined pivot range. The predetermined pivot range is a range in which the flag 1 is positioned at the full load detection position Pm or above and at the uppermost position Pt or below. The sensor F is changed from a state in which the output signal is OFF (hereinafter referred to as "off state") to a state in which the output signal is ON (hereinafter referred to as "on state") by the flag 1 pivoting from a lower position and reaching the full load detection position Pm. That is, the full load detection position Pm serving as the target position is a position in which the sensor F starts detection of the flag 1. Further, in a state where the flag 1 is positioned at the full load detection position Pm or above and the uppermost position Pt or below, the sensor F maintains the on state. As described, since the sensor F detects the base portion 1*d* closer to the pivot axis P than the tip portion 1*b*, the photosensing element can be downsized.

Control Unit

The control unit 40 includes, as illustrated in FIG. 3, a CPU 41, a ROM 42 and a RAM 43. The various functions of the control unit 40 can be realized, for example, by the CPU 41 executing programs stored in the ROM 42 using the RAM 43 as a work area. Signals indicating the detection results output from the sensors E1, E2 and F are entered to the control unit 40 configured as above.

Sheet Discharge Operation

Figure 6A:
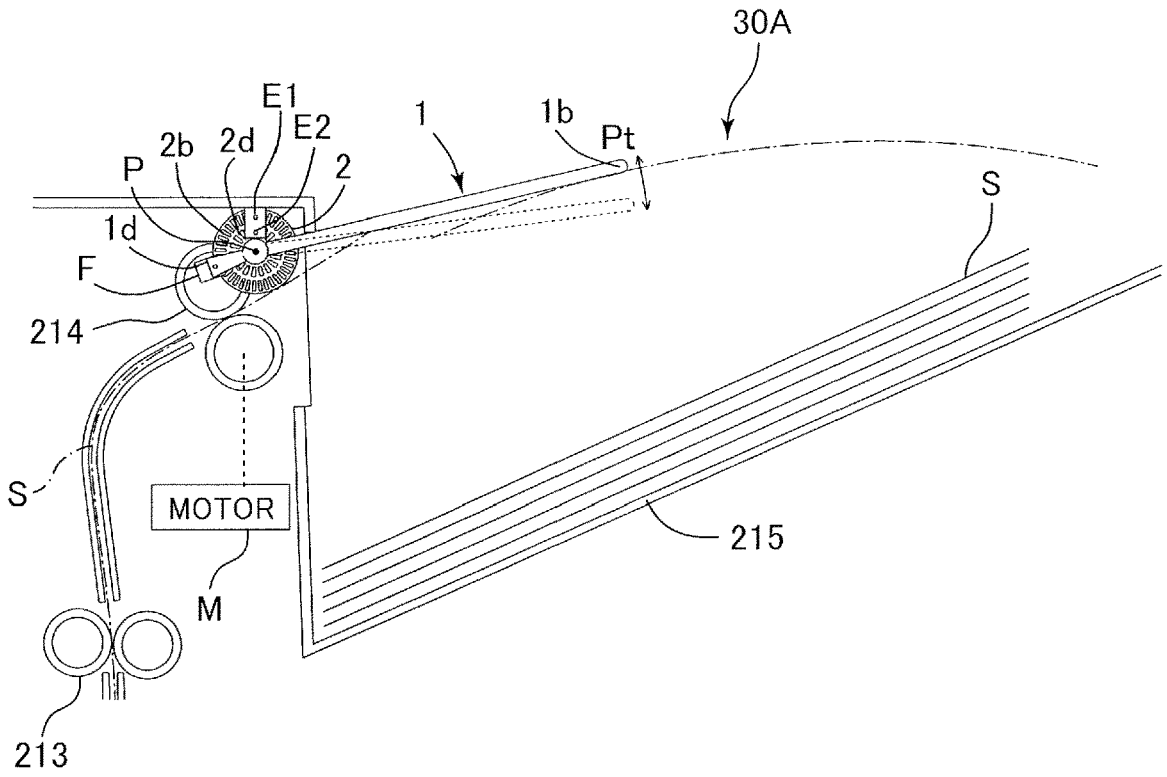
FIG. 6A is a cross-sectional view illustrating an operation outline of the sheet discharge apparatus during continuous discharge.

Next, an outline of the sheet discharge operation will be described, taking a case where a job for discharging a plurality of sheets S continuously (hereinafter referred to as "continuous discharging job") is entered to the sheet discharge apparatus 30A described above. FIG. 4A is a view illustrating an operation outline of the sheet discharge apparatus 30A of a case where the amount of load of the sheet S loaded on the sheet discharge tray 215 is approximately smaller than ⅓ of the number of sheets to be loaded in the full load status (hereinafter referred to as "small-loaded state"). FIG. 5A is a view illustrating an operation outline of the sheet discharge apparatus 30A of a case where the amount of load of the sheet S loaded on the sheet discharge tray 215 is approximately half the number of sheets to be loaded in the full load status (hereinafter referred to as "middle-loaded state"). FIG. 6A is a view illustrating a continuous discharging operation of the sheet S by the sheet discharge apparatus 30A.

Figure 4B:
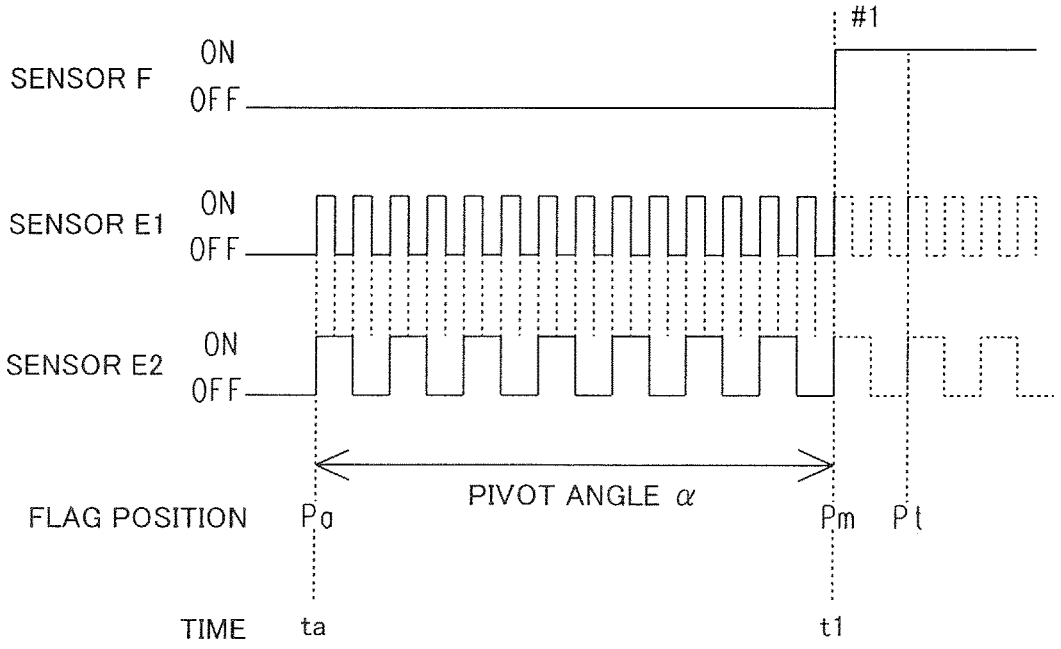
FIG. 4B is a view illustrating an example of a signal waveform that the respective sensors output in a case where the amount of sheet load is in a small-loaded state.

As illustrated in FIG. 4A, if a continuous discharging job is received in a state where the sheet discharge tray 215 is in a small-loaded state, the flag 1 is positioned at a contact position Pa before the first sheet S reaches the sheet discharge roller pair 214. Then, the first sheet S of the continuous discharging job pushes the flag 1 up from the contact position Pa. The flag 1 is disposed to be pushed up higher than the full load detection position Pm by the sheet S being discharged, and in the present embodiment, the flag 1 is designed to be pushed up to the uppermost position Pt by the sheet S. The pivot disk 2 pivots along with the flag 1, and the sensors E1 and E2 receive the light having passed through the slits 2*b* and 2*d* formed on the pivot disk 2, by which the sensors E1 and E2 output pulse signals as illustrated in FIG. 4B. The number of pulses of the pulse signals is proportional to the pivot angle value of the flag 1 and the pivot disk 2 being pivoted.

Further, in a state where the flag 1 is pushed up from below and moves beyond the full load detection position Pm, the sensor F is switched from OFF to ON. The control unit 40 counts the number of pulses that the sensors E1 and E2 output while the flag 1 is pushed up by the discharged sheet S until it reaches the full load detection position Pm, that is, from time ta to time t1. Then, the control unit 40 calculates the pivot angle $\alpha$ from the contact position Pa to the full load detection position Pm based on the number of pulses being counted.

Further, as illustrated in FIG. 5A, if a continuous discharging job is received in a state where the sheet discharge tray 215 is in the middle-loaded state, the flag 1 is positioned at a contact position Pb before the first sheet S reaches the sheet discharge roller pair 214. The tip portion 1*b* of the flag 1 positioned at the contact position Pb is higher than the contact position Pa. Then, the first sheet S of the continuous discharging job pushes up the flag 1 from the contact position Pb to the uppermost position Pt. At this time, as illustrated in FIG. 5B, the control unit 40 counts the number of pulses that the sensors E1 and E2 output while the flag 1 is pushed up from the contact position Pb to the full load detection position Pm, that is, from time tb to time t1. Then, the control unit 40 calculates the pivot angle $\theta$ from the contact position Pb to the full load detection position Pm based on the number of pulses being counted. The pivot angle $\beta$ is smaller than the pivot angle $\alpha$. As described, the control unit 40 can calculate the pivot angle from the initial position of the flag 1 when the continuous discharging job has been received (for example, the contact positions Pa and Pb) to the full load detection position Pm.

Figure 6B:
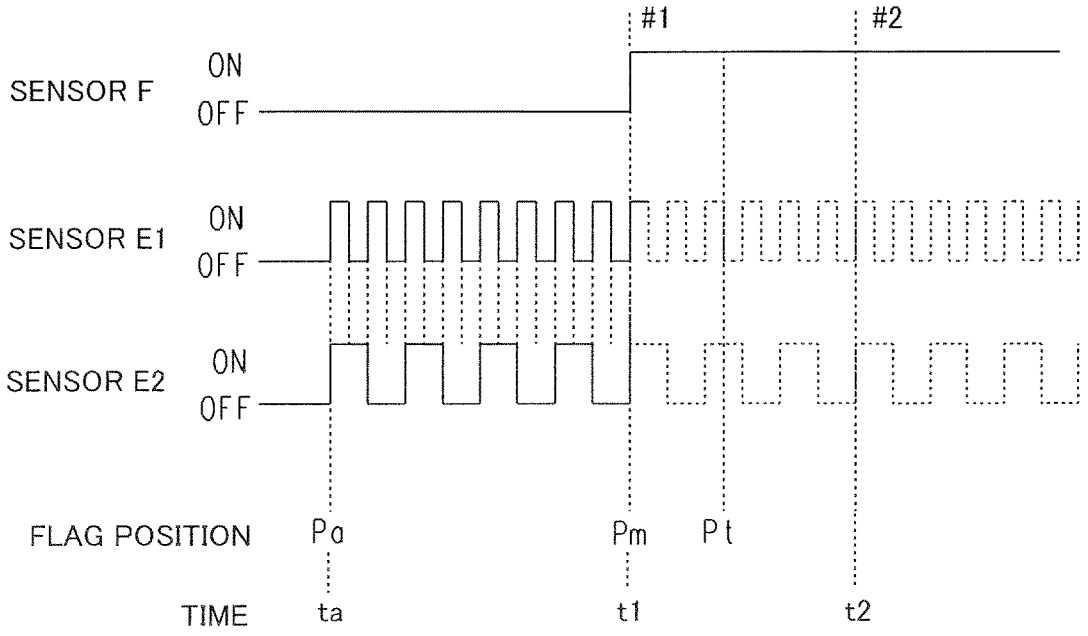
FIG. 6B is a view illustrating an example of a signal waveform that the respective sensors output in a case where continuous discharge of sheets is started in a state where the amount of sheet load is in a small-loaded state.

If a sheet interval between a preceding sheet and a succeeding sheet being discharged is shortened to improve productivity, as illustrated in FIG. 6A, the tip portion 1*b* of the flag 1 will oscillate without coming into contact with the sheet S on the sheet discharge tray 215 when discharging the second and subsequent sheets S of the continuous discharging job. That is, if the flag 1 is pushed up to the uppermost position Pt by the sheet S discharged as the first sheet and the trailing edge of the first sheet S passes the tip portion 1*b* of the flag 1, the flag 1 starts to descend by its own weight. However, the flag 1 is pushed up again to the uppermost position Pt by the second sheet S being discharged subsequently. As a result, the flag 1 oscillates in up-down directions within a range where the sensor F is ON, that is, in the range from the full load detection position Pm or above and the uppermost position Pt or below. In FIG. 6B, from time t1, the output signals of the respective sensors are shown in a state where the flag 1 is oscillated within the range between the full load detection position Pm and the uppermost position Pt. In FIG. 6B, the output signals of the sensors E1 and E2 are simplified, but depending on the type of the sheet S, the flag repeats fine up-down movement between the full load detection position Pm and the uppermost position Pt caused by the stiffness of the sheet S itself. As a result, very fine ON and OFF repeatedly occurs to the output signals of the sensors E1 and E2. By setting the slit widths of the slits 2*b* and 2*d* to different widths, that is, by providing the slits with different resolving powers, the pivoting direction can be distinguished by the combination thereof, so that the amount of rotation to one direction in total can be acquired based on the number of pulses.

Figure 7A:
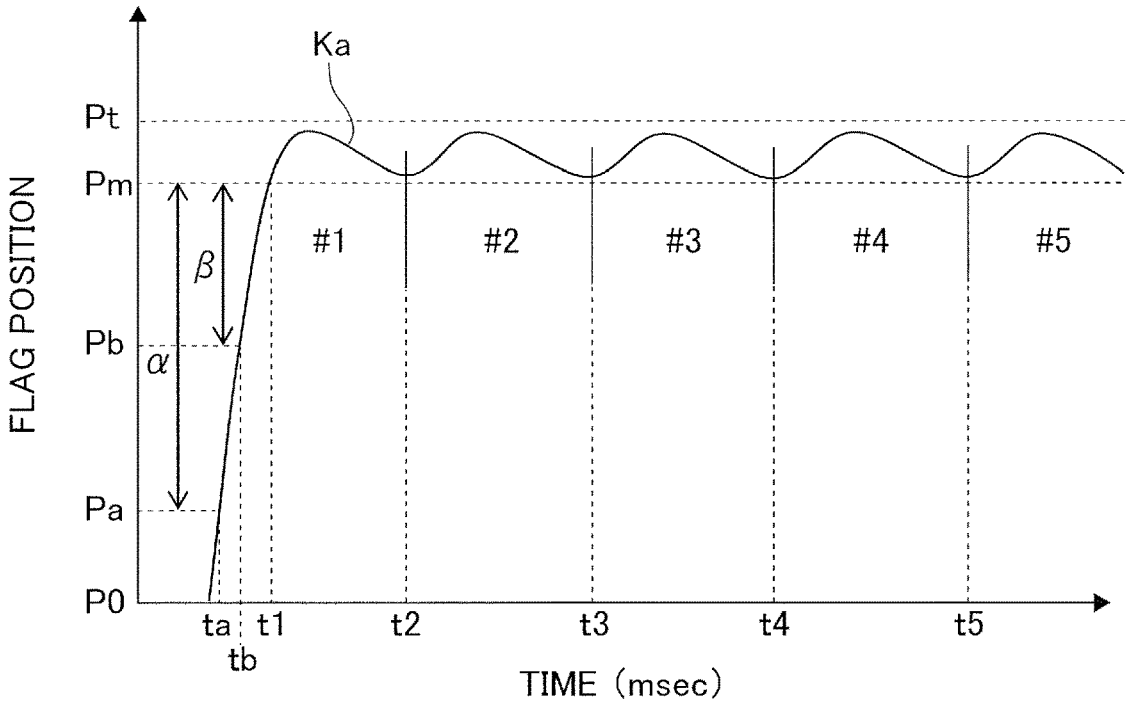
FIG. 7A is a graph illustrating displacement of a pivot member during normal state.

Thereby, as illustrated in FIG. 7A, the flag 1 performs a determined pivoting action Ka after discharging the first sheet, as illustrated in FIG. 7A. The period in which the flag 1 performs pivoting action between the full load detection position Pm and the uppermost position Pt by the k-th sheet S being discharged is referred to as period #k (k>1). Stationary pivoting action of the flag 1 during period #k is referred to as stationary action, and the stationary output waveform of the sensor E1 and E2 by stationary action is referred to as a stationary waveform.

Figure 7B:
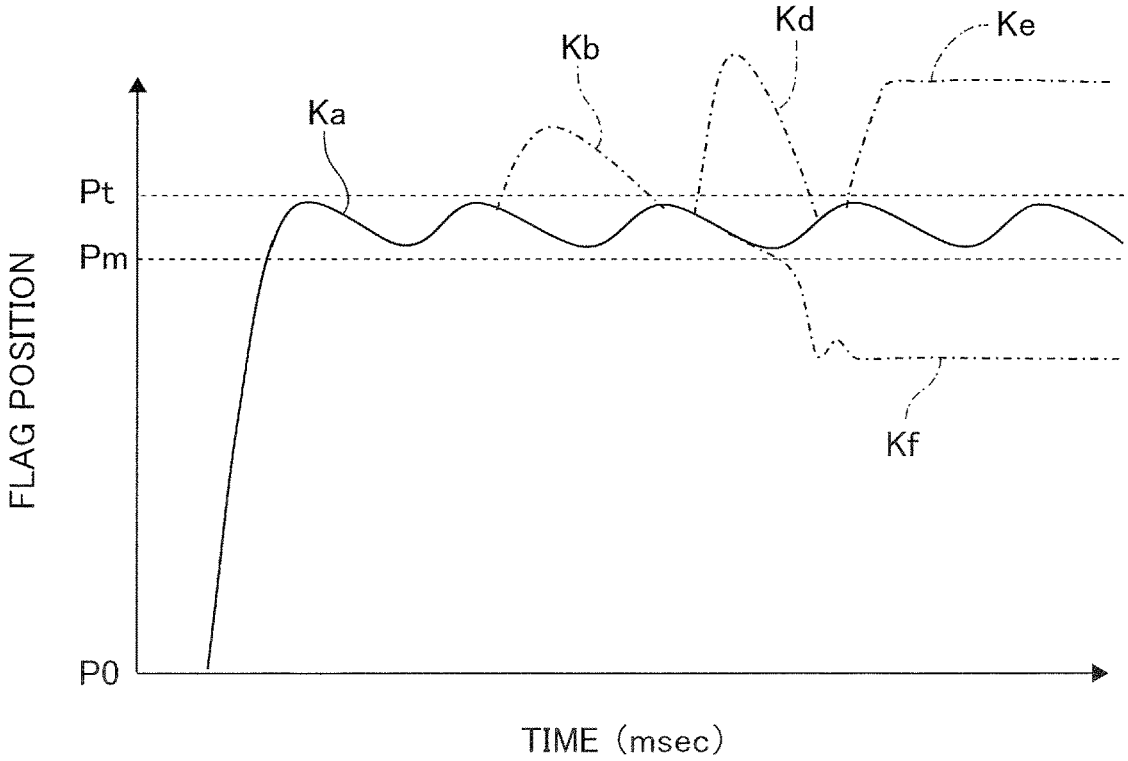
FIG. 7B is a graph illustrating displacement of the pivot member during occurrence of abnormality.

If abnormality occurs during continuous discharge of the plurality of sheets S, as illustrated in FIG. 7B, the flag 1 shows a behavior that differs from the stationary action illustrated in FIG. 7A. Abnormality of discharge action of the sheet S occurs, for example, by discharge failure of the sheet S, or by the user touching the flag 1 or the sheet S being discharged. For example, if the user touches the flag 1 or the sheet S being discharged by some reason, the flag 1 performs pivoting action Kb and pivoting action Kd, deviating from the pivoting action Ka during stationary action. For example, if the flag 1 is maintained at the lifted state by some external factor, the flag 1 performs pivoting action Ke, deviating from pivoting action Ka during stationary action. Further, if the flag 1 is maintained at the lowered position by some external factor, the flag 1 deviates from the pivoting action Ka during stationary action and performs pivoting action Kf. While the flag 1 behaves abnormally, the output waveform of the sensors E1 and E2 shows a different waveform as the stationary waveform, including significant changes.

The control unit 40 (refer to FIG. 3) monitors the output waveform of the sensors E1 and E2 and detects abnormality that has occurred during execution of the continuous discharging job by detecting a waveform that differs from the stationary waveform. Further, if it is determined that the sensor F has switched from the on state to the off state during discharge of the plurality of sheets S by a first sheet interval described later, the control unit 40 determines that the flag 1 and the pivot disk 2 have exceeded a determined pivot range. That is, the control unit 40 determines that abnormality has occurred in a state where the plurality of sheets S are discharged continuously by a first sheet interval. If such abnormality is detected, the control unit 40 stops the motor M and stops discharge of the sheet S.

Full Load Control

Next, full load control during printing performed by the sheet discharge apparatus 30A will be described with reference to the flowchart of FIG. 8. If a continuous discharging job such as a print job is received, at first, the sheet discharge roller pair 214 discharges the first sheet S to the sheet discharge tray 215. At this time, the flag 1 is pushed up by the first sheet S, and the control unit 40 detects pivot angle $\theta$ (refer to FIG. 2) as a first pivot angle of the flag 1 based on the detection result of the detecting unit 50 composed of the pivot disk 2 and the sensors E1, E2 and F (step S1).

As described, the operation for discharging at least one sheet by the sheet discharge roller pair 214 to detect the pivot angle θ is referred to as a first discharge operation(step S1). The detecting unit 50 can detect either a pivot angle θ of the flag 1 during which the flag 1 is pushed by the leading edge of the sheet and swung up or a pivot angle θ of the flag 1 during which the flag 1 is released from the trailing edge and swung down. The sheet interval of the sheet being discharged during the first discharge operation is not limited, and for example, it can be the first sheet interval or the second sheet interval described later, or can be other sheet intervals. Furthermore, if the number of sheets discharged in the first discharge operation is two or greater, the pivot angle θ of the flag 1 pivoted by the second or subsequent sheet can be detected instead of the first sheet. Moreover, it is also possible to detect the pivot angles two or more times, instead of detecting only one pivot angle of the flag 1, and to determine the average pivot angle as the pivot angle θ.

Then, the control unit 40 calculates a number of loadable sheets P1 based on the detected pivot angle θ (step S2). The number of loadable sheets P1 refers to a value of the number of sheets that can be discharged by the sheet discharge roller pair 214 before the uppermost sheet S loaded on the sheet discharge tray 215 reaches the height of the tip portion 1*b* of the flag 1 positioned at the full load detection position Pm.

Next, the control unit 40 determines whether the number of sheets to be printed by the print job (hereinafter referred to as "number of sheets of print job") is greater than the number of loadable sheets P1 (step S3). If the number of sheets of the print job is equal to or smaller than the number of loadable sheets P1 (step S3: NO), the control unit 40 determines whether printing has been performed to the number of sheets of the print job (step S13). If printing is performed to the number of sheets of the print job (step S13: YES), printing is completed.

If printing is not performed to the number of sheets of the print job (step S13: NO), the next sheet is printed (step S14). Thereafter, the control unit 40 determines whether the output waveform of the sensors E1 and E2 while discharging sheets is in the predetermined state, that is, in the stationary waveform (step S15). If the output waveform of the sensors E1 and E2 during discharge of sheets is a stationary waveform (step S15: YES), the procedure returns to step S13. If the output waveform of the sensors E1 and E2 during discharge of sheets is not a stationary waveform (step S15: NO), the control unit 40 determines that abnormality has occurred (step S16), and stops discharge of the sheets S. In other words, if the control unit 40 determines that abnormality has occurred in a case where the sheet discharge roller pair 214 continuously discharges sheets in the second discharge operation and the fourth discharge operation, the printer 200 stops printing (step S12).

Meanwhile, in step S3, if the number of sheets of the print job is greater than the number of loadable sheets P1 (step S3: YES), the control unit 40 determines whether the number of loadable sheets P1 is greater than ten, which is the number of sheets set as margin (step S4). According to the sheet discharge apparatus 30A of the present embodiment, if the amount of sheets S supported on the sheet discharge tray 215 reaches the height of the tip portion 1*b* of the flag 1 positioned at the full load detection position Pm, it is desirable to stop printing with high accuracy by full load control. Therefore, a margin (according to the present embodiment, ten sheets) is set arbitrarily based on processing ability, loadable number of sheets, corresponding sheet types and so on of the image forming apparatus with respect to the number of loadable sheets P1. Then, after discharging a number of sheets acquired by subtracting the margin from the number of loadable sheets P1, the pivot angle θ is detected again as described later, and the number of loadable sheets P1 that can be discharged before reaching the full load status is acquired.

If the number of loadable sheets P1 is greater than ten, set as the margin (step S4: YES), the control unit 40 allows printing of a subsequent sheet, and the subsequent sheet is printed (step S5). In this state, the sheet interval of the sheets S from the first sheet to the (P1-10)th sheet is set to a relatively short first sheet interval so that the flag 1 oscillates between the full load detection position Pm and the uppermost position Pt. Next, the control unit 40 determines whether the output waveform of the sensors E1 and E2 during discharge of sheets is in a predetermined state, that is, a stationary waveform (step S6). If the output waveform of the sensors E1 and E2 during sheet discharge is not a stationary waveform (step S6: NO), the control unit 40 determines that abnormality has occurred (step S16) and stops printing of the printer 200 (step S12). If the output waveform of the sensors E1 and E2 during sheet discharge is a stationary waveform (step S6: YES), the control unit 40 confirms whether printing has been performed so that the remaining number of sheets is ten, or (P1-10) (step S7). The operation of discharging a number of sheets acquired based on the pivot angle θ detected in step S1 at a first sheet interval is referred to as a second discharge operation (steps S5 through S7).

Figure 9:
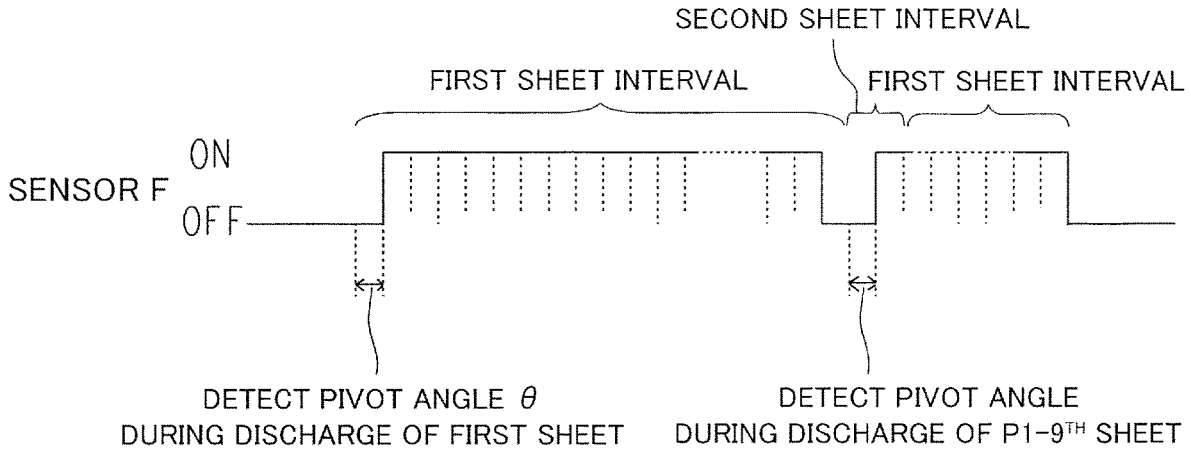
FIG. 9 is a view illustrating an output waveform of the sensor F in a continuous discharge job.

If printing has not been performed up to the last ten sheets (step S7: NO), the procedure returns to step S5, and step S5 and the subsequent steps are performed. If printing is performed up to the last ten sheets (step S7: YES), the printer 200 performs printing of the (P1-9)th sheet S by changing the sheet interval from the first sheet interval to a second sheet interval that is greater than the first sheet interval (step S8). The sheet interval of the sheets S is changed by the control unit 40 controlling the motor M that drives the sheet discharge roller pair 214 (refer to FIG. 2) or by changing the sheet feed timing of the sheet feeding unit 20. The second sheet interval is an interval that allows the tip portion 1*b* to descend and contact the uppermost sheet supported on the sheet discharge tray 215 before the subsequent sheet S pushes the flag 1. Therefore, as illustrated in FIG. 9, before the (P1-9)th sheet is discharged by the sheet discharge roller pair 214, the flag 1 is lowered to the full load detection position Pm which is the lower limit of the predetermined pivot range of the full load detection position Pm or above and the uppermost position Pt or below, and pivots to a position beyond the predetermined pivot range. Since the flag 1 is moved beyond the predetermined pivot range before the (P1-9)th sheet S is discharged, the sensor F transits from the on state to the off state. Specifically, the flag 1 is swung down until it contacts the uppermost sheet supported on the sheet discharge tray 215. After the (P1-9)th sheet S is discharged, the procedure returns to step S1, and the steps from step S1 and subsequent steps are performed. Sheet discharge other than step S8 is performed at the first sheet interval. As described, the operation of discharging at least one sheet at a second sheet interval by the sheet discharge roller pair 214 so as to detect the pivot angle θ is referred to as a third discharge operation (step S1).

In this state, the detecting unit 50 detects a new pivot angle θ of the flag 1 as a second pivot angle, and based on the newly detected pivot angle θ, a new number of loadable sheets P1 is calculated. As described, sheet discharge before reaching full load can be performed with high accuracy by correcting the number of loadable sheets P1. For example, if the new number of loadable sheets P1 is 10 sheets or less, in step S4, the control unit 40 determines that the number of loadable sheets P1 is smaller than 10 sheets set as margin (step S4: NO). Then, the control unit 40 determines whether the number of loadable sheets P1 has been actually printed (step S9). If it is determined that the number of loadable sheets P1 have not been printed (step S9: NO), the control unit 40 prints the subsequent sheet (step S10), and determines whether the output waveform of the sensors E1 and E2 during sheet discharge is a stationary waveform (step S11).

If the output waveform of the sensors E1 and E2 during sheet discharge is not a stationary waveform (step S11: NO), the control unit 40 determines that abnormality has occurred (step S16) and stops printing of the printer 200 (step S12). If the output waveform of the sensors E1 and E2 during sheet discharge is a stationary waveform (step S11: YES), the procedure returns to step S9. If it is determined that printing has been performed to reach the number of loadable sheets P1 (step S9: YES), the control unit 40 determines that printing has been performed to a full load state of the sheet discharge tray 215 (step S17), and printing of the printer 200 is stopped (step S12).

As described, the operation of discharging sheets at a first sheet interval for a number of sheets calculated based on pivot angle θ detected by the second step S1 is called a fourth discharge operation (steps S9 through S11). In the fourth discharge operation, the detecting unit 50 can detect either a pivot angle θ of the flag 1 during which the flag 1 is pushed by the leading edge of the sheet and swung up or a pivot angle θ of the flag 1 during which the flag 1 is released from the trailing edge and swung down. The sheet interval of the sheet being discharged during the fourth discharge operation is not limited to the first sheet interval, and for example, it can be any interval as long as it is smaller than the second sheet interval. Furthermore, the above-described first to fourth discharge operation are not necessarily executed continuously, and it is possible to execute other operations between the first to fourth discharge operation.

As described, if the number of sheets of the print job is greater than the number of loadable sheets P1 and if abnormality is not detected, printing is continued while repeating correction of the number of loadable sheets P1 (steps S1 through S8) until the control unit 40 determines full load (step S17). If the control unit 40 determines full load or abnormality, it reports the error information to the user through an operation panel (not shown) provided on the printer 200 and stops printing. In order to resume printing, the user must perform appropriate operation in response to the error information. In order to resume printing, for example, the user must perform appropriate operation such as removal of sheets S from the sheet discharge tray 215 if full load is detected, or removal of external factor of the flag 1 or removal of jammed sheets if abnormality is detected.

The above-described full load control is an example that does not include steps performed after printing is stopped, but it can also include steps that are performed after printing is stopped. For example, the full load control can further include a step of confirming, after printing is stopped, whether the sheet discharge tray 215 is fully loaded. Further, if it is determined that the sheet discharge tray 215 is not fully loaded as a result of the confirmation, the procedure may return to step S1 illustrated in FIG. 8 and print the remaining number of steps. As another example, full load control can also include a step of resuming printing if it is determined that abnormality has been resolved after stopping printing and conditions for resuming printing has been satisfied.

In the printer 200 in which printing is stopped, it is at least necessary for the sensors E1 and E2 to maintain an on state or an off state to determine that abnormality has been resolved. Since the sheet S is not discharged in the printer 200 in which printing is stopped, normally, the flag 1 does not move. Therefore, normally the sensors E1 and E2 will maintain the on state or the off state. Further, as for the conditions for resuming printing, the conditions should at least include that the number of sheets S supported on the sheet discharge tray 215 after printing has stopped has not reached the full load number of sheets, that is, that the flag 1 is stopped at a height lower than the full load detection position Pm. Whether the number of sheets S supported on the sheet discharge tray 215 has not reached the full load number of sheets is determined by the control unit 40 based on the output signal of the sensor F. Specifically, if the output signal of the sensor F is OFF, the control unit 40 determines that the number of sheets S supported on the sheet discharge tray 215 has not reached the full load number of sheets. If the number of sheets S supported on the sheet discharge tray 215 has not reached the full load number of sheets, for example, the procedure can return to step S1 illustrated in FIG. 8 to print the remaining number of sheets. It is also possible to add to the condition for resuming printing that a sensor for sensing state of device related to image forming and sheet discharge among the sensors detecting abnormality of states of devices inside the sheet discharge apparatus 30A is not outputting a signal that indicates abnormality.

Figure 8:
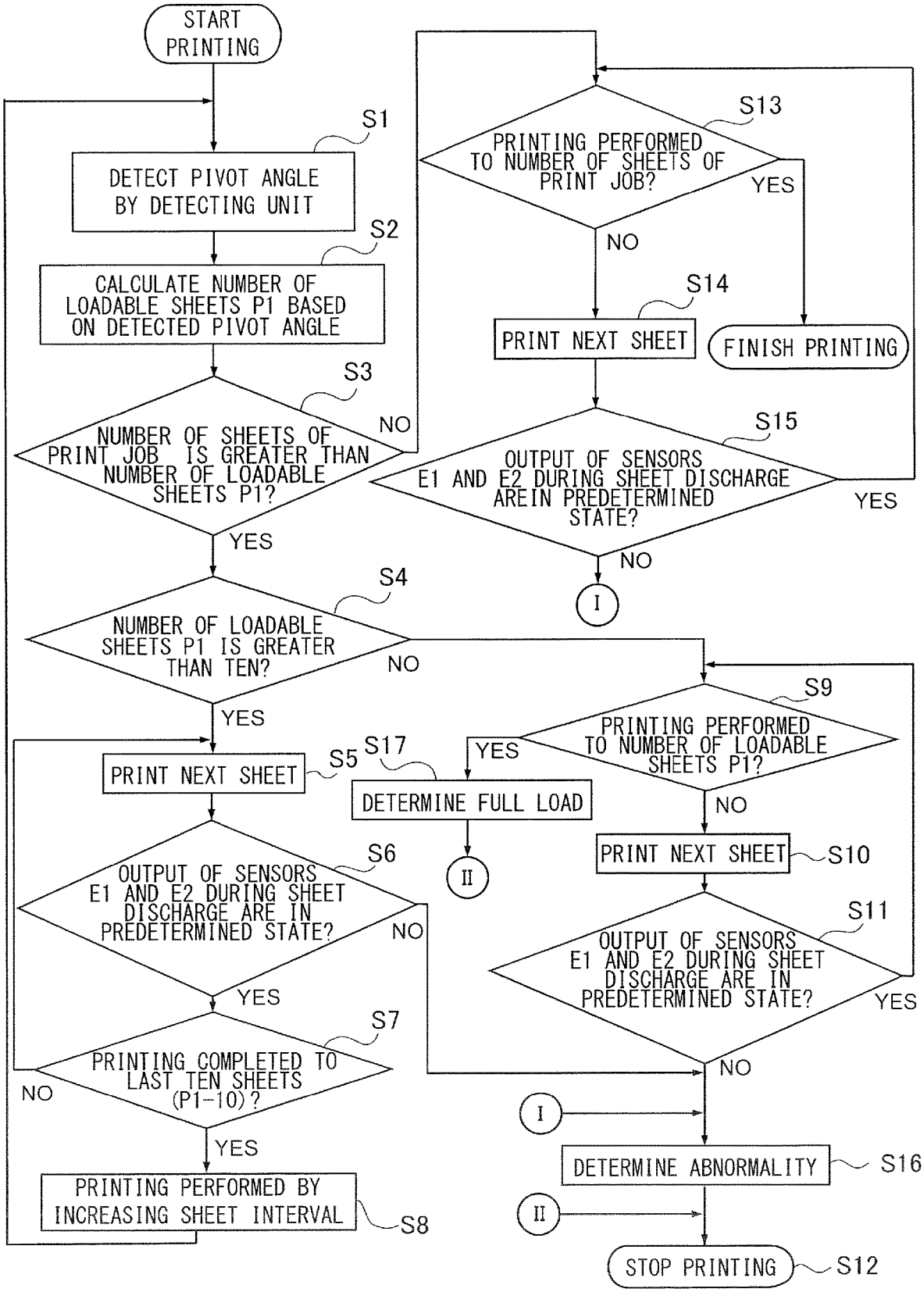
FIG. 8 is a flowchart illustrating a full load control in the sheet discharge apparatus.

In steps S7 and S8 of the flowchart of FIG. 8, if sheets S are continuously discharged up to ten more sheets to full load, the control unit 40 increases the sheet interval from the first sheet interval to the second sheet interval greater than the first sheet interval. However, the timing for increasing the sheet interval from the first sheet interval to the second sheet interval is not limited to this timing. For example, if there are a large number of sheets of the print job, the sheet interval can be increased from the first sheet interval to the second sheet interval and the number of loadable sheets P1 can be recalculated before the remaining number of sheets reaches ten sheets, such as each time the number of continuously discharged sheets S reaches 20.

In step S9 of the flowchart of FIG. 8, the control unit 40 determines that the sheet discharge tray 215 has become fully loaded in a state where it has been determined that printing has been performed to the number of loadable sheets P1 (step S9: YES) (step S17). However, the determination of full load is not limited thereto. In the flow of step S9 and thereafter, since the number of loadable sheets P1 is 10 or smaller, the number of sheets S that can be discharged is small. Therefore, instead of the process of step S9, the control unit 40 can determine full load of the sheet discharge tray 215 by increasing the sheet interval from the first sheet interval to the second sheet interval and based on the detection result of the sensor F. Even if the control unit 40 determines full load of the sheet discharge tray 215 based on the detection result of the sensor F, continuous printing can be performed at the first sheet interval until only a small number of sheets S remain to be discharged, so that productivity can be improved compared to the prior art.

As described above, according to the present embodiment, in continuous discharge of a plurality of sheets S, the pivot angle θ (refer to FIG. 2) of the flag 1 pressed by the first sheet is detected by the detecting unit 50. Therefore, the sheet discharge apparatus 30A is capable of calculating a number of sheets that can be discharged or supported without any hindrance even by continuously discharging sheets S at a short sheet interval base on the pivot angle θ, and preventing erroneous detection of the full load status and stopping of discharge of the sheets S caused by erroneous detection of the full load status. Therefore, according to the present embodiment, even if sheets S are continuously discharged at a short sheet interval, the number of sheets S determined based on the pivot angle θ can be continuously discharged at a first sheet interval having a short sheet interval without reducing the number of sheet discharge per unit time, that is, without deteriorating productivity. Further according to the present embodiment, sheets S can be continuously discharged without erroneously detecting the full load status by setting a shorter first sheet interval, so that productivity can be enhanced even further According further to the present embodiment, after continuously discharging the number of sheets S calculated based on the pivot angle θ (such as number of loadable sheets P1 - 10 sheets), the sheet discharge apparatus 30A increases the sheet interval to a second sheet interval that is longer than the first sheet interval. Since the sheet interval is increased to the second sheet interval, the flag 1 is swung down once from the full load detection position Pm and contacts the uppermost sheet S supported on the sheet discharge tray 215. Therefore, the sheet discharge apparatus 30A is capable of detecting the new pivot angle θ and calculates the loadable number of sheets on the sheet discharge tray 215 more accurately based on the new pivot angle θ. Therefore, according to the present embodiment, the stackable number of sheets on the sheet discharge tray 215 can be recognized more accurately, and erroneous detection of the full load status and stopping of discharge of the sheet S caused by erroneous detection of the full load status can be prevented more securely.

In the present embodiment, the sensors E1 and E2 of the sheet discharge apparatus 30A output pulse signals that have mutually different periodicity or phase. Therefore, the sheet discharge apparatus 30A can distinguish the pivoting direction of the flag 1 and the pivot disk 2 based on two outputs obtained respectively from the sensors E1 and E2.

Further according to the present embodiment, the control unit 40 (refer to FIG. 3) detects that sensors E1 and E2 are outputting a waveform that differs from the stationary waveform, such as in a state where sudden change of output of the sensor E1 or E2 occurs during continuous discharge of the sheet S. Therefore, according to the present embodiment, errors caused by some reason can be detected. Further, it becomes possible to speedily cope with errors that have occurred due to some cause, for example, by urgently stopping continuous discharge of sheets S.

Second Embodiment

Next, a second embodiment of the present invention will be described. The second embodiment adopts a pivot disk 3 and a sensor E1 instead of the pivot disk 2 and the sensors E1 and E2 according to the first embodiment. In the present embodiment, components similar to the first embodiment are either not shown in the drawing or denoted with the same reference numbers and descriptions thereof are omitted.

Figure 10A:
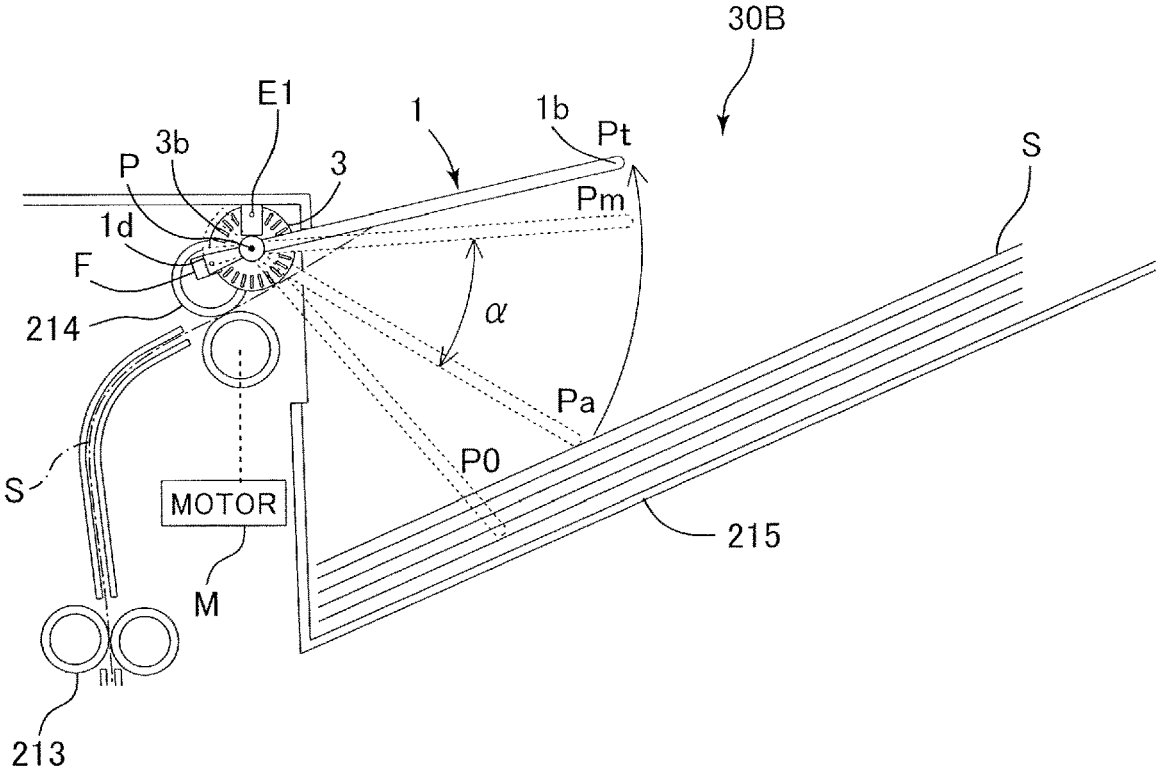
FIG. 10A is a cross-sectional view illustrating an operation outline of a sheet discharge apparatus according to a second embodiment in a state where the amount of sheet load is in a small-loaded state.

A sheet discharge apparatus 30B includes, as illustrated in FIG. 10A, a sheet discharge roller pair 214, a sheet discharge tray 215, a flag 1 serving as a pivot member, a pivot disk 3, a sensor E1, and a sensor F serving as a target position detecting portion. The pivot disk 3 is arranged coaxially with the flag 1, and is integrally pivotable with the flag 1 around the pivot axis P. A plurality of slits 3*b* are formed along the pivoting direction on the pivot disk 3. In the pivot disk 3, the plurality of slits 3*b* constitute one row of slits.

Figure 11A:
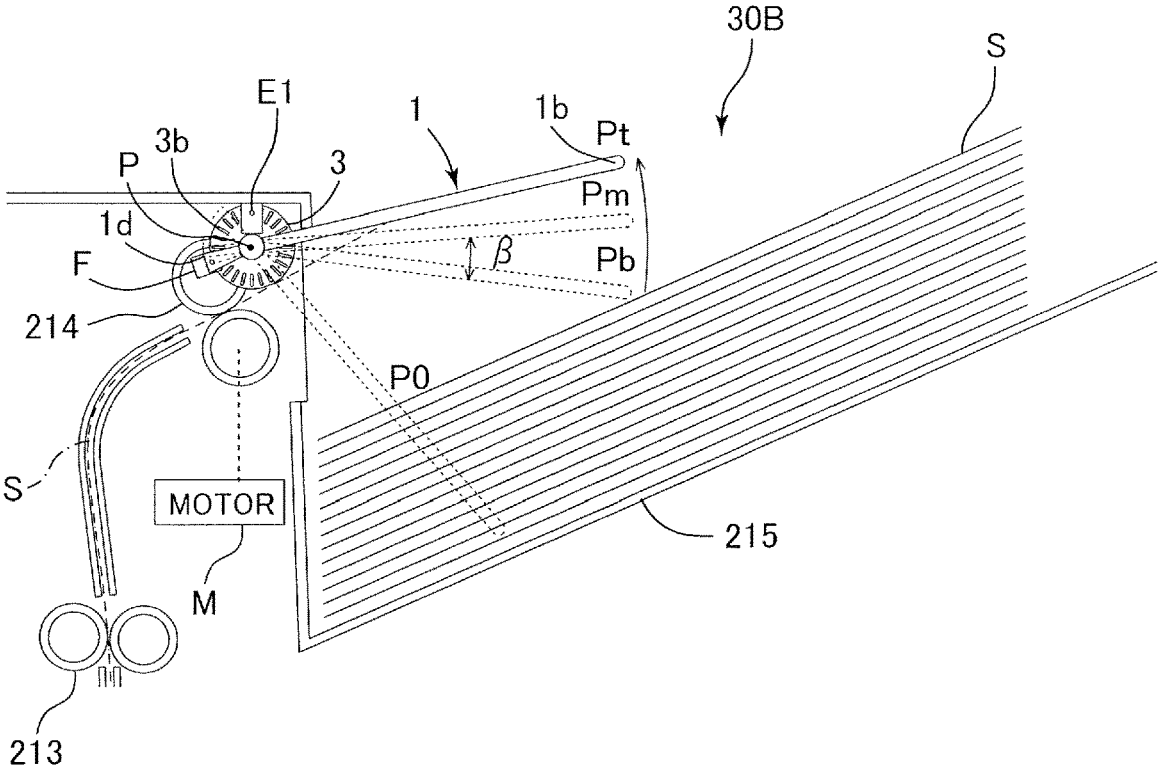
FIG. 11A is a cross-sectional view illustrating an operation outline of a sheet discharge apparatus in a case where the amount of sheet load is in a middle-loaded state.
Figure 12:
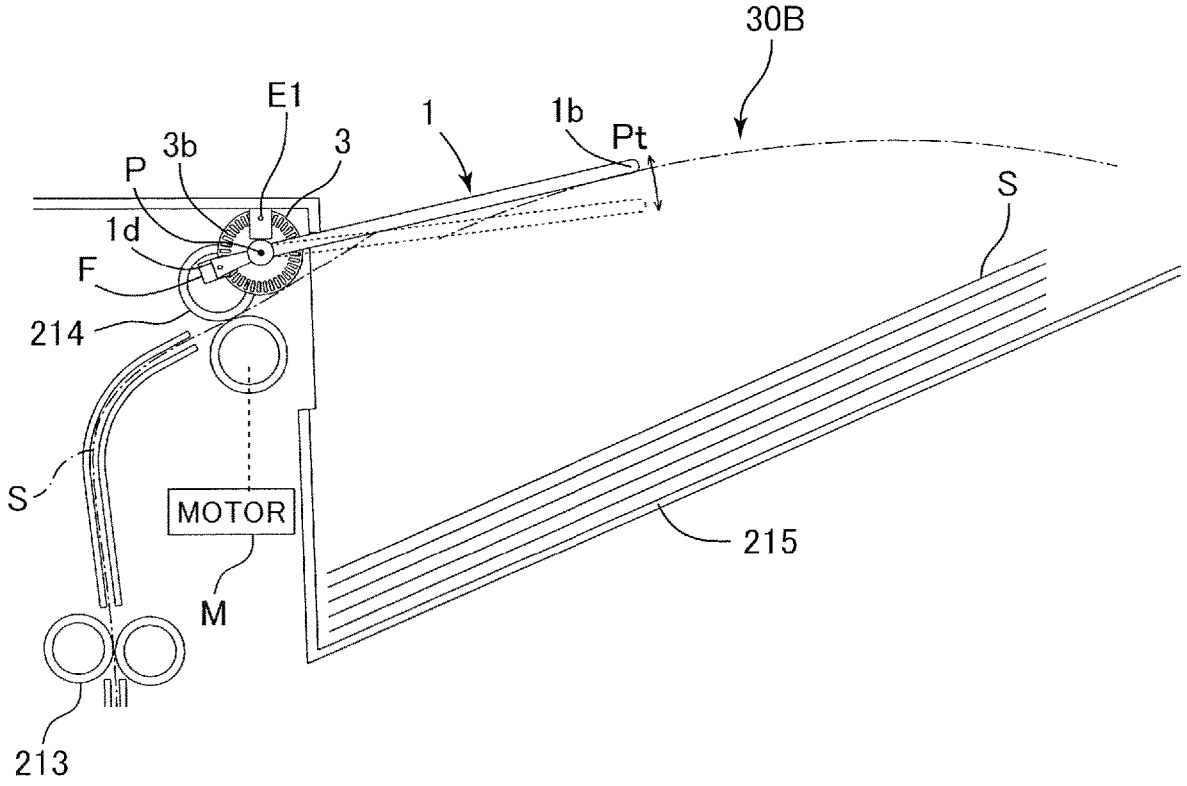
FIG. 12 is a cross-sectional view illustrating an operation outline in a case where the sheet discharge apparatus is performing continuous discharge.

The sheet discharge apparatus 30B configured in this manner operates similarly as the sheet discharge apparatus 30A. That is, in a state where the flag 1 is raised to the full load detection position Pm, the slit 3*b* traverses an optical path connecting a light emitting element E1*a* and a photosensing element E1*b* (refer to FIG. 3). In a state where the flag 1 is raised to the full load detection position Pm, in the case of a small-loaded state illustrated in FIG. 10A, a pivot angle α is detected when a first sheet S is discharged, and in the case of a middle-loaded state illustrated in FIG. 11A, a pivot angle θ is detected when the first sheet S is discharged. Further, if the sheet S is continuously discharged without abnormality in the sheet discharge apparatus 30B, as illustrated in FIG. 12, the tip portion 1*b* pivots in the up-down direction without coming into contact with the uppermost sheet S stacked on the sheet discharge tray 215.

Figure 10B:
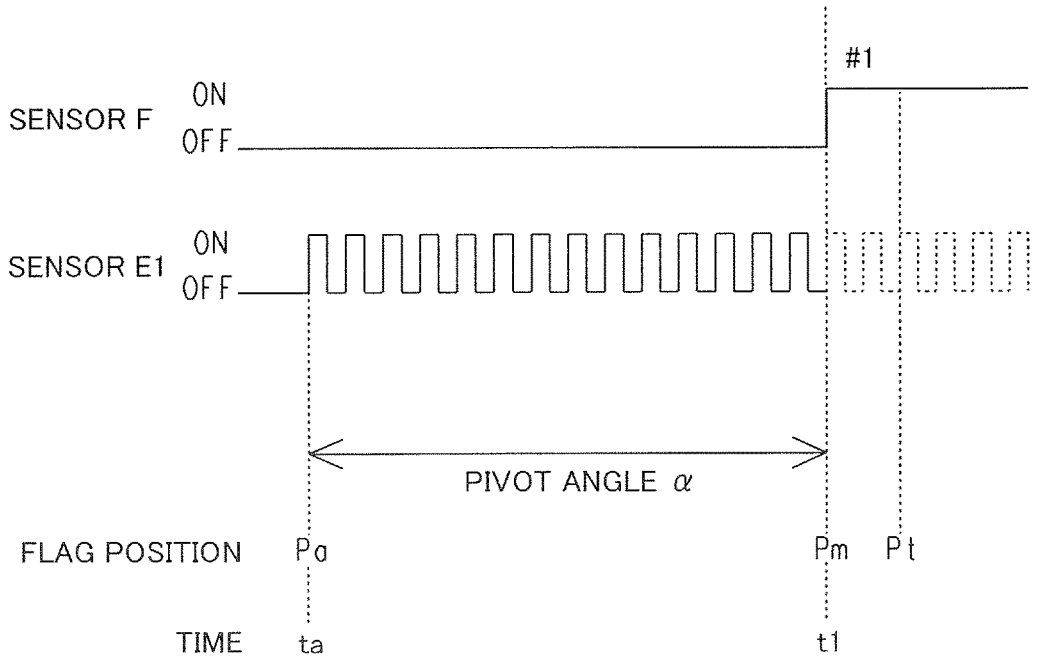
FIG. 10B is a view illustrating an example of a signal waveform that the respective sensors output in a case where the amount of sheet load is in a small-loaded state.
Figure 11B:
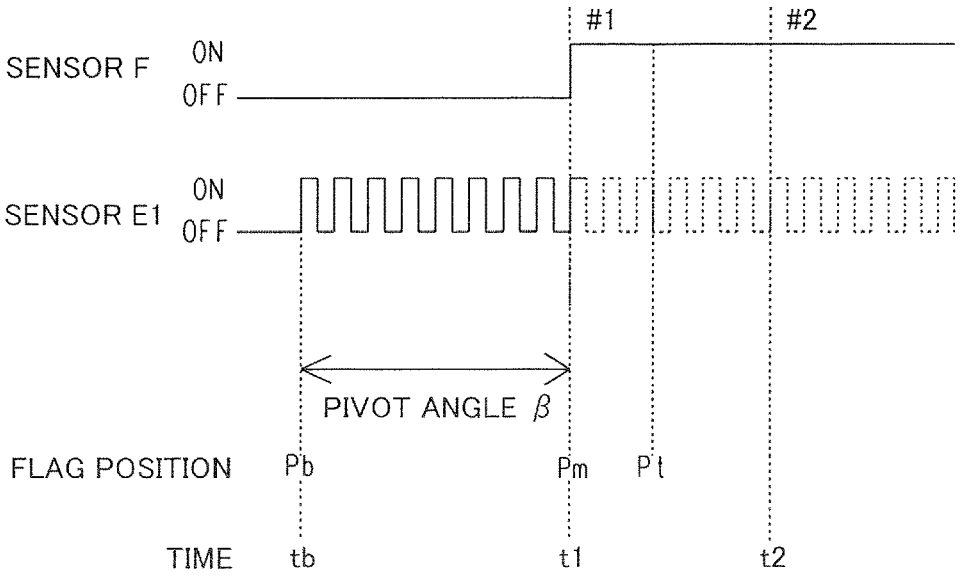
FIG. 11B is a view illustrating an example of a signal waveform that the respective sensors output in a case where the amount of sheet load is in a middle-loaded state.

Meanwhile, in the sheet discharge apparatus 30B, since the sensor E2 is not provided in the sheet discharge apparatus 30A, the information that the control unit 40 (refer to FIG. 3) receives does not include the output of the sensor E2 regarding the sheet discharge apparatus 30A. Therefore, in the case of the small-loaded state illustrated in FIG. 10A, signals are output from two sensors F and E1 in the sheet discharge apparatus 30B, as illustrated in FIG. 10B. Further, in the case of the middle-loaded state illustrated in FIG. 11A, signals are output from two sensors F and E1, as illustrated in FIG. 11B. The signals output from the sensors F and E1 in the sheet discharge apparatus 30B are similar to the signals output from the sensors F and E1 in the sheet discharge apparatus 30A. In the sheet discharge apparatus 30B, pivot angles α and β serving as first pivot angles are respectively detected based on output from time ta to time t1 and from time tb to time t1, based on the outputs of the sensor E1. In other words, the pivot angle α is detected based on the number of pulses of the pulse signals output from time ta to time t1, and the pivot angle β is detected based on the number of pulses of the pulse signals output from time tb to time t1.

Figure 13:
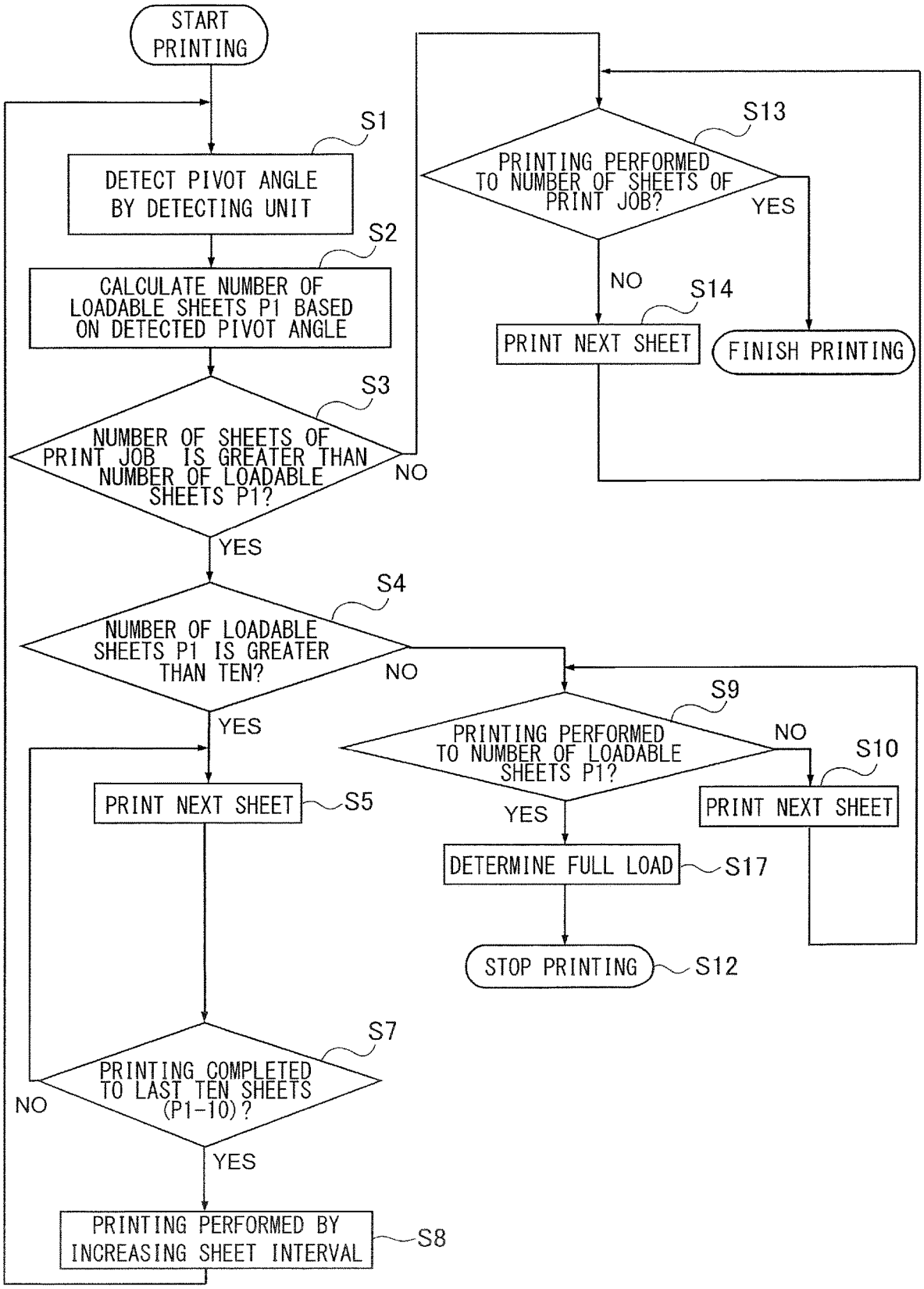
FIG. 13 is a flowchart illustrating a full load control in the sheet discharge apparatus.

FIG. 13 is a flowchart illustrating a full load control of the sheet discharge apparatus 30B according to the second embodiment. Since the sensor E2 is omitted in the full load control according to the present embodiment, steps S15, S6 and S11 which are steps for detecting abnormal state in FIG. 8 of the first embodiment are omitted. Therefore, as illustrated in FIG. 13, the procedures respectively proceed from steps S14, S5 and S10 to steps S13, S7 and S9.

According to the present embodiment, when performing continuous discharge of a plurality of sheets S, the pivot angle of the flag 1 swung up by the discharged sheet reaching the full load detection position Pm can be detected based on the output signals of a single sensor E1. Therefore, an effect similar to the first embodiment can be achieved in the present embodiment that adopts a detecting unit having a configuration that is simpler than the first embodiment.

Third Embodiment

Next, a third embodiment of the present invention will be described. The third embodiment is configured by adopting a pivot disk 4 and the sensor E1 instead of the pivot disk 2 and sensors E1 and E2 of the first embodiment. In comparison to the second embodiment, the third embodiment is configured by adopting the pivot disk 4 instead of the pivot disk 3 of the second embodiment. In the present embodiment, configurations that are similar to the first and second embodiments are either not shown or denoted with the same reference numbers and descriptions thereof are omitted.

Figure 14A:
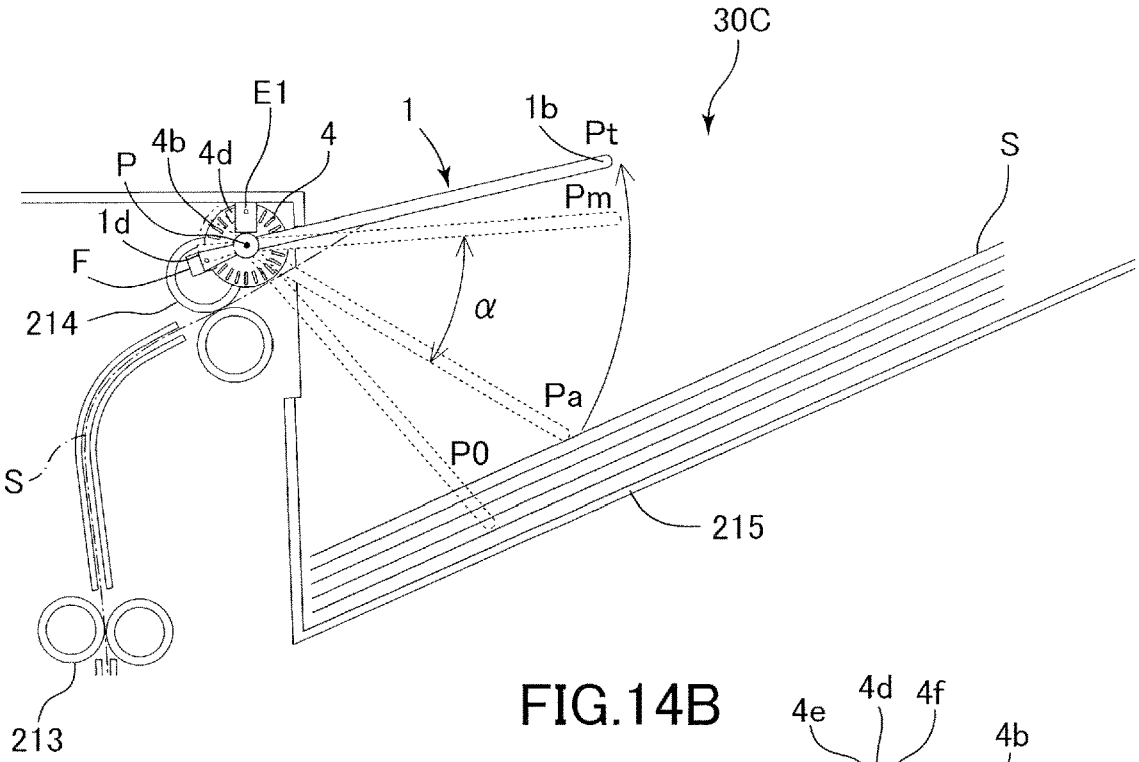
FIG. 14A is a cross-sectional view illustrating an operation outline of a sheet discharge apparatus according to a third embodiment in which an amount of sheet load is in a small-loaded state.
Figure 14B:
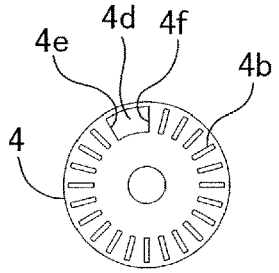
FIG. 14B is an enlarged view of a pivot disk.
Figure 14C:
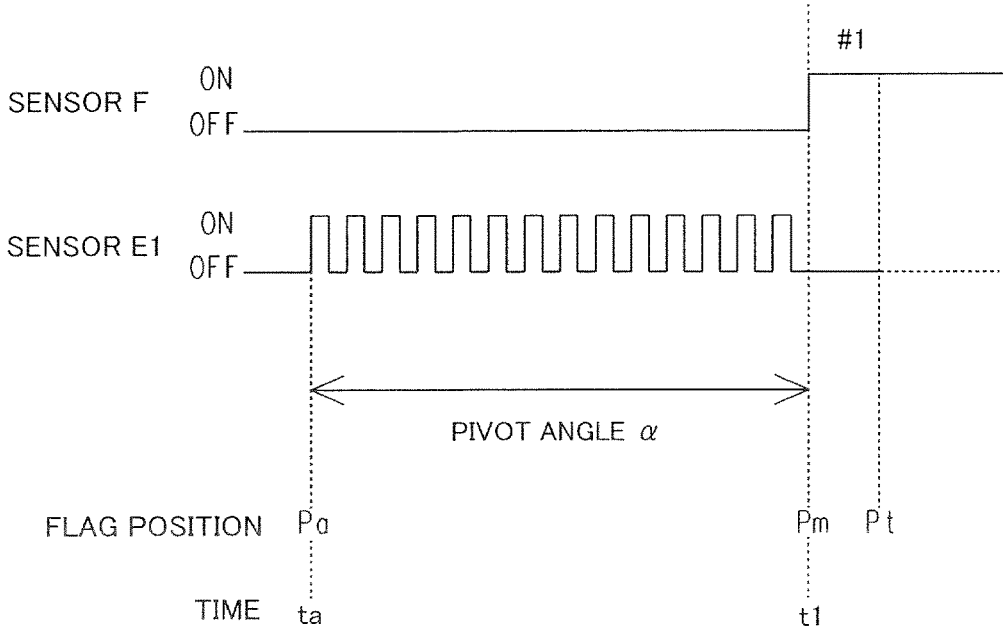
FIG. 14C is a view illustrating an example of a signal waveform that the respective sensors output in a case where the amount of sheet load is in a small-loaded state.

The sheet discharge apparatus 30C according to the third embodiment includes, as illustrated in FIG. 14A, a sheet discharge roller pair 214, a sheet discharge tray 215, a flag 1 and a pivot disk 4 serving as a pivot member, a sensor E1, and a sensor F serving as a target position detecting portion. The pivot disk 4 is arranged coaxially with the flag 1, and it is integrally pivotable with the flag 1 around the pivot axis P. A plurality of slits 4*b* and a single slit 4*d* are formed along a pivoting direction of the pivot disk 4. In the pivot disk 4, the slits 4*b* and the slit 4*d* constitute a single row of slits. The lengths of the slits 4*b* and the slit 4*d* differ in the pivoting direction of the pivot disk 4, as illustrated in FIG. 14B. The distance of the slit 4*d* serving as a wide slit is longer in the pivoting direction than the other slits 4*b*. The length of the slit 4*d* in the pivoting direction, that is, the distance between a first end 4*e* and a second end 4*g* corresponds to a pivot angle of the pivot disk 4 in a state where the flag 1 pivots between the full load detection position Pm and the uppermost position Pt.

Figure 15A:
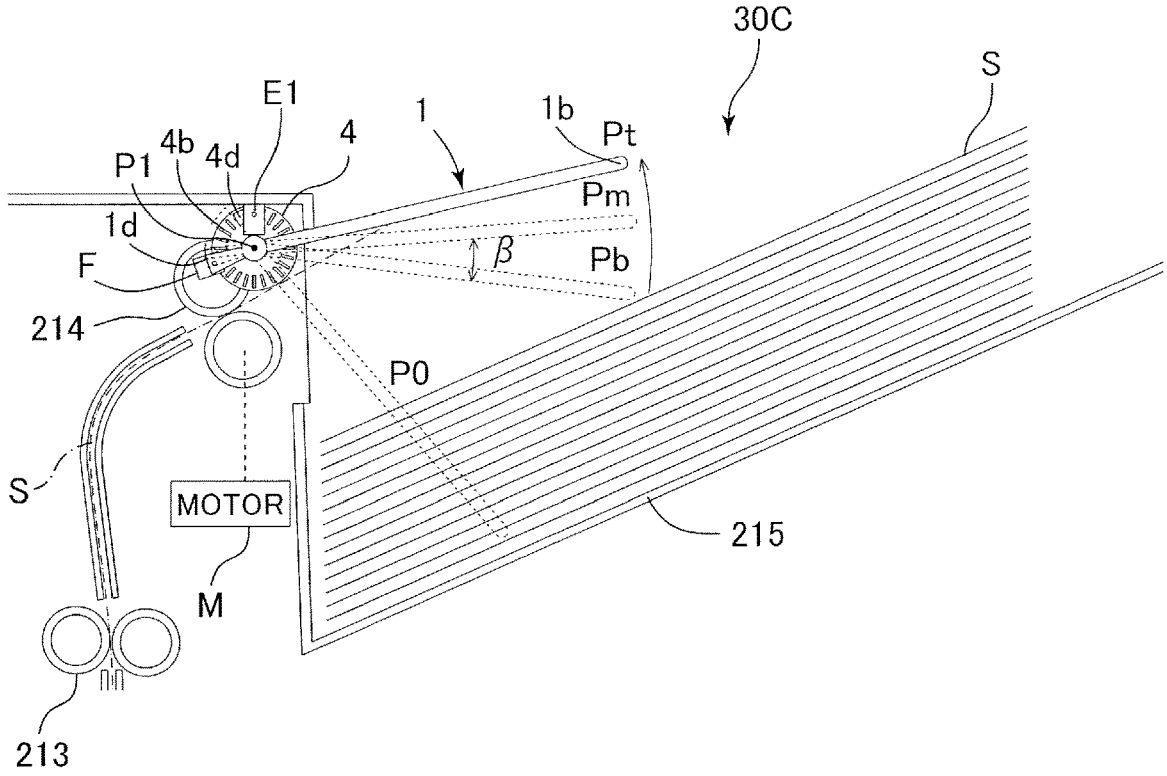
FIG. 15A is a cross-sectional view illustrating an operation outline of the sheet discharge apparatus in a case where the amount of sheet load is in a small-loaded state.
Figure 15B:
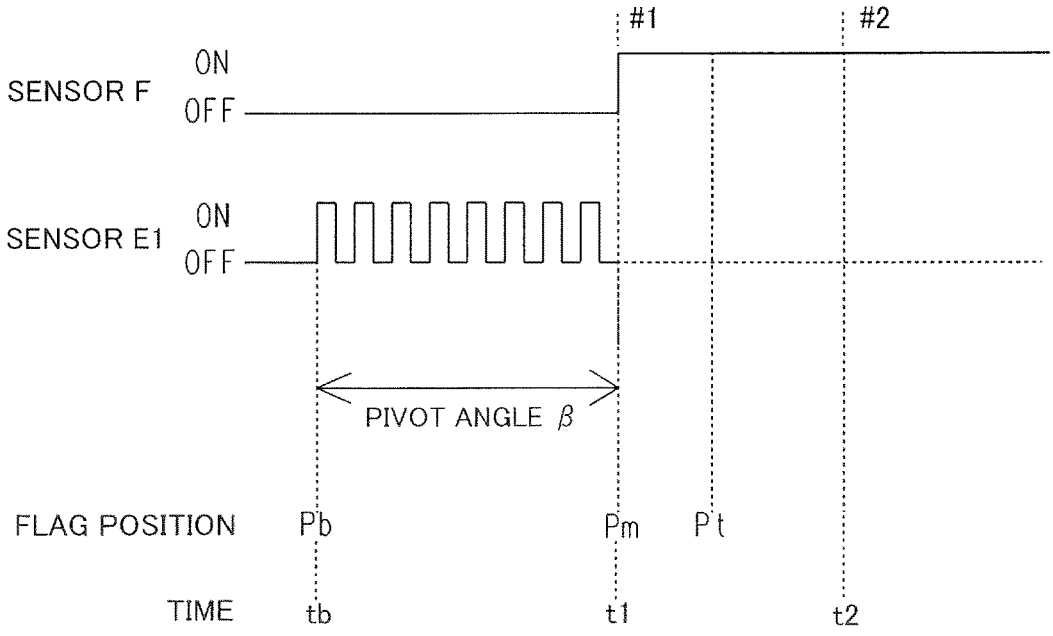
FIG. 15B is a view illustrating an example of a signal waveform that the respective sensors output in a case where the amount of sheet load is in a middle-loaded state.
Figure 16:
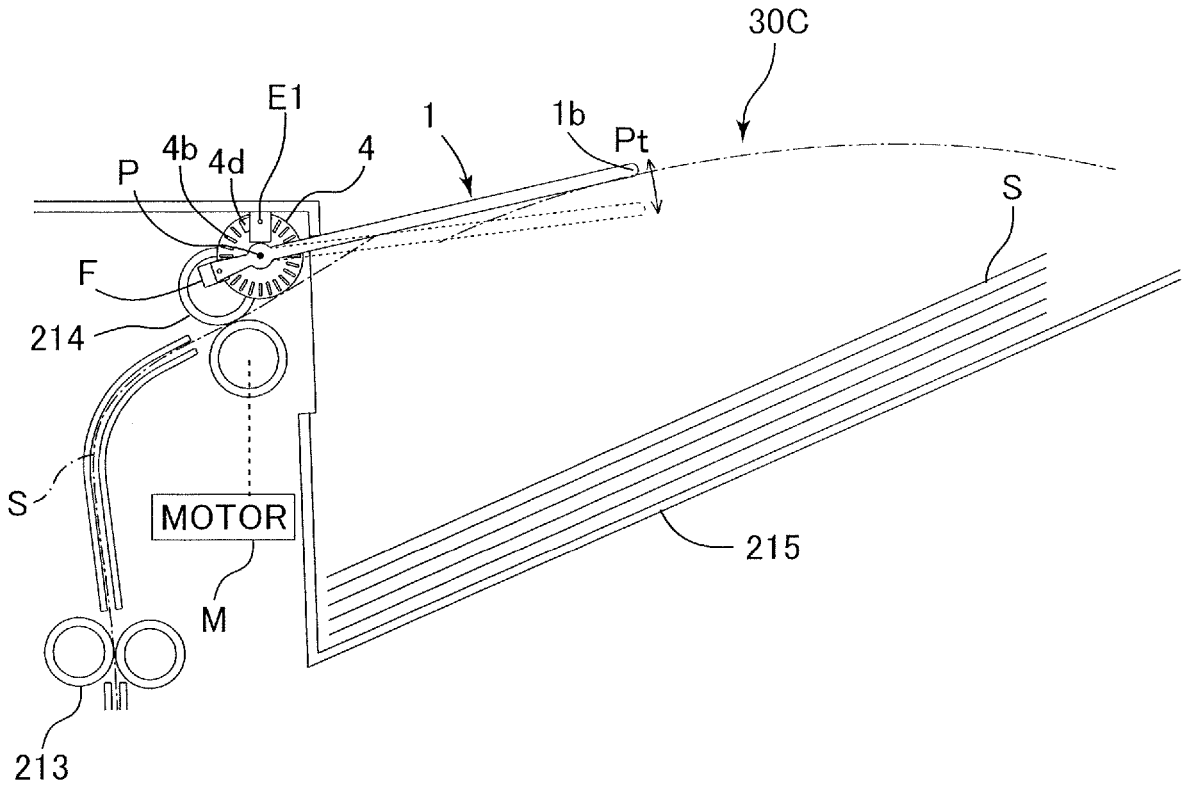
FIG. 16 is a cross-sectional view illustrating an operation outline in a case where continuous discharge is performed in the sheet discharge apparatus.

The sheet discharge apparatus 30C configured as above operates similarly as the sheet discharge apparatus 30A. That is, in a state where the flag 1 is lifted to the full load detection position Pm, the slits 4*b* traverse the optical path connecting the light emitting element E1*a* and the photosensing element E1*b* (refer to FIG. 3). In a state where the flag 1 is lifted to the full load detection position Pm, in the case of the small-loaded state illustrated in FIG. 14A, pivot angle $\alpha$ is detected when the first sheet S is discharged, and in the case of the middle-loaded state illustrated in FIG. 15A, pivot angle $\theta$ is detected when the first sheet S is discharged. Furthermore, in the sheet discharge apparatus 30C, if sheets S are continuously discharged without causing abnormality, as illustrated in FIG. 16, the tip portion 1*b* pivots up and down without coming into contact with the uppermost sheet S supported on the sheet discharge tray 215.

Meanwhile, in the sheet discharge apparatus 30C, the sensor E2 is omitted in the sheet discharge apparatus 30A, and the pivot disk 4 is adopted instead of the pivot disk 2, so that the output signal from the sensor E1 differs. In a state where the flag 1 is positioned at the full load detection position Pm, the first end 4*e* reaches the optical path connecting the light emitting element and the photosensing element. Further, in a state where the flag 1 is positioned at the uppermost position Pt, the second end 4*f* reaches the optical path connecting the light emitting element and the photosensing element. Therefore, if the flag 1 is positioned at the predetermined pivot range of the full load detection position Pm or above and the uppermost position Pt or below, the light emitted from the light emitting element E1*a* serving as the third light emitting element passes through the slit 4*d* and is received by the photosensing element E1*b* serving as the third photosensing element. Meanwhile, if the flag 1 is positioned outside the predetermined range, the light emitted from the light emitting element E1*a* will not pass through the slit 4*d* and is not received by the photosensing element E1*b*. Therefore, if the flag 1 is positioned within the predetermined range, the sensor E1 will be in an off state. If the flag 1 is positioned outside the predetermined range, the sensor E1 will be in an on state.

Figure 17:
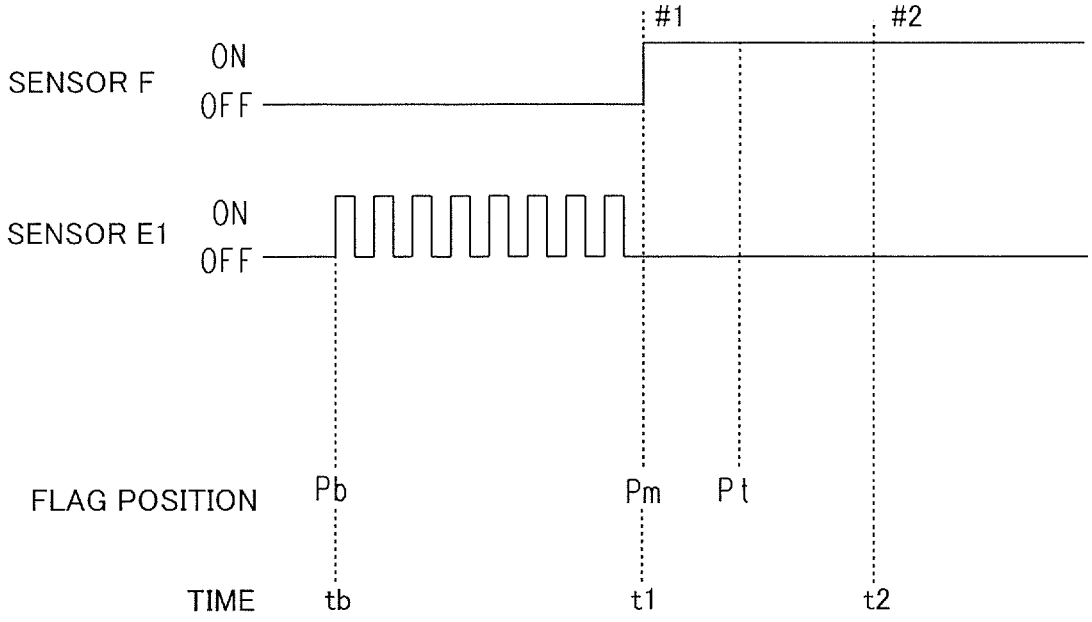
FIG. 17 is a view illustrating an example of a signal waveform that the respective sensors output in a case where continuous discharge of sheets is started in a state where the amount of sheet load is in a middle-loaded state.

Meanwhile, in the sheet discharge apparatus 30C, similar to the sheet discharge apparatus 30A, the control unit 40 (refer to FIG. 3) monitors the output signal of the sensor E1, and by detecting a waveform that differs from the waveform during normal state, it detects the error that has occurred during continuous discharge of a plurality of sheets S. During continuous discharge of the plurality of sheets S at a first sheet interval, if the state is normal, the flag 1 is displaced within a range of the full load detection position Pm or above and the uppermost position Pt or below in the sheet discharge apparatus 30C. Accordingly, as illustrated in the example of FIG. 17, the output signal of the sensor E1 maintains an off state during normal state. In a case where a waveform that differs from the waveform observed when the sensor E1 maintains an off state is observed, as in the case where the output signal of the sensor E1 transits from off to on, the control unit 40 determines that abnormality has occurred in the sheet discharge apparatus 30C. As described, in the sheet discharge apparatus 30C, abnormality is detected based on whether the sensor E1 has not transited from the off state to the on state after transiting to the off state at time t1 when the first sheet S has started pressing the flag 1.

Figure 18:
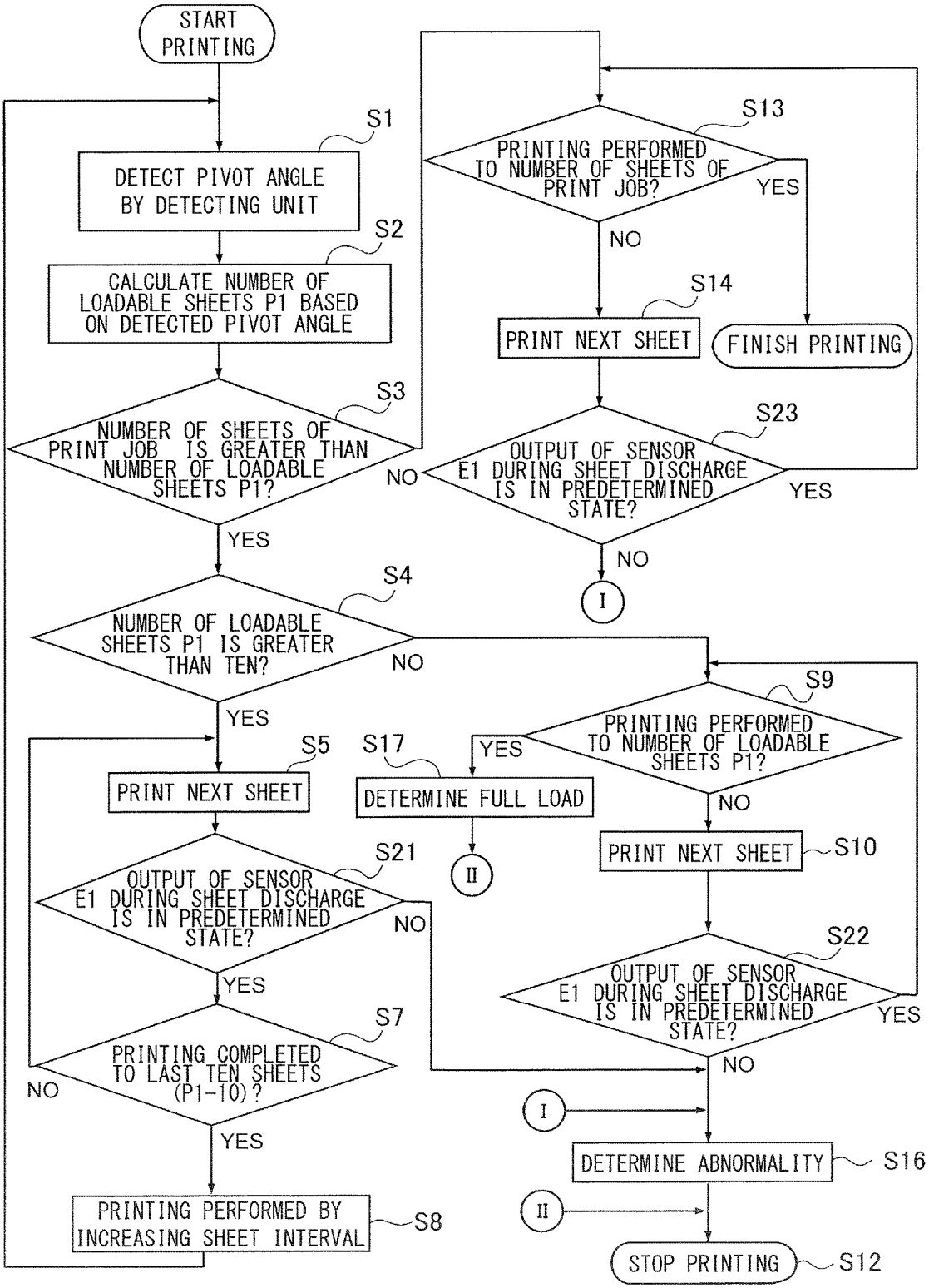
FIG. 18 is a flowchart illustrating a full load control in the sheet discharge apparatus.

FIG. 18 is a flowchart illustrating a full load control of the sheet discharge apparatus 30C according to the third embodiment. According to the full load control of the present embodiment, the pivot disk 4 and the sensor E1 are adopted instead of the pivot disk 2 and the sensors E1 and E2 in the first embodiment, so that the content of the step for detecting an abnormal state in the full load control differs from that of the first embodiment. In the full load control of the present embodiment, steps S23, S21 and S22 which are steps for detecting an abnormal state are performed instead of steps S15, S6 and S11 according to the full load control illustrated in FIG. 8 of the first embodiment. In the respective steps of steps S21 through S23, the control unit 40 (refer to FIG. 3) determines whether the sensor E1 during sheet discharge is in a predetermined state, that is, as illustrated in FIG. 17, determines whether the sensor E1 maintains the off state. The other steps are similar to the full load control according to the first embodiment.

According to the present embodiment, the sensor E1 maintains an off state when the flag 1 is displaced within the predetermined pivot range of the full load detection position Pm or above and the uppermost position Pt or below, so that abnormality is detected based on the output of the single sensor E1. Further according to the present embodiment, the sensor E1 monitored for detecting abnormality during continuous discharge of a plurality of sheets S maintains an off state during normal state, so that the observed waveform is easily recognized, and abnormality detection is facilitated.

The present invention is not limited to the embodiments described above, and can be implemented in various forms other than those described above, so that various modifications are made possible within the scope of the present invention without deviating from the subject matter of the present invention. For example, the size, material, shape and relative arrangement of components of the present invention can be varied arbitrarily according to the configuration of the apparatus and various conditions.

For example, the above-described embodiments have been illustrated taking the printer 200 as an example of the image forming apparatus, but the present invention can also be applied to an ink-jet type image forming apparatus in which image is formed on the sheet by discharging ink through nozzles. According further to the present embodiment, the printer 200 having the sheet discharge apparatus 30A, 30B or 30C including the control unit 40 has been described, but the present invention can be applied to a finisher serving as a sheet discharge apparatus connected to the printer 200 and performing various processes, and in that case, a combination of the printer 200 and the finisher can also serve as the image forming apparatus.

According to the embodiment described above, in discharging a plurality of sheets S continuously, an example has been described of a case where a determined number of sheets is first discharged at a first sheet interval based on the pivot angle, and then a single sheet S is discharged at a second sheet interval that is longer than the first sheet interval, but the present invention is not limited to this example. The number of sheets S discharged at the second sheet interval should be at least one, but it can be two or greater. Further according to the embodiment described above, an example of a case where the margin set to the number of loadable sheets P1 is 10 (refer to FIGS. 8, 13 and 18) has been described, but the margin can be set to any number between 0 and 9, or higher than 11.

In the above-described embodiment, an example has been described of a case where the loadable number of sheets is calculated based on the pivot angle θ (refer to FIG. 2) detected in a case where the tip portion 1*b* of the flag 1 is lifted (FIG. 2), but the loadable number of sheets can also be computed based on the pivot angle θ that is detected when the tip portion 1*b* is lowered. According further to the above-described embodiment, the pivot disks 2, 3, 4 and an optical sensor as an example of a sensor are adopted, and the pivot angle θ is detected based on the information output from the optical sensor, but the configuration for detecting the pivot angle θ is not limited to this example. For example, instead of an optical rotary encoder including pivot disks 2, 3 and 4 and an optical sensor, a configuration capable of detecting the pivot angle θ such as a magnetic rotary encoder or a potentiometer can be adopted arbitrarily. According to the described example, the information output from the sensor are pulse signals, but the information is not limited to pulse signals, as long as the pivot angle θ can be detected. The information output from the sensor can be electric signals other than pulse signals or physical quantities such as current values or voltage values. Further according to the above-described embodiment, an example has been described of a case where the pivot disks 2, 3 and 4 are formed in a circular shape when viewed from the front side, but the disks can also be of other shapes such as a fan shape, as long as the pivoting movement around the pivot axis P is not blocked and the slits appear in equal distances in the pivoting direction.

Further, for example, as long as the relative positional relationship between the slits 3*b* of the pivot disk 3 and the optical sensor is maintained, the relative positional relationship between the slits and the optical sensor is not limited to the example illustrated in FIG. 10 and so on. In the sheet discharge apparatus 30B illustrated in FIG. 10, the position of the sensor E1 does not move and the slits 3*b* move in the pivoting direction, but in contrast, a configuration can be adopted in which the positions of the slits do not move and the position of the sensor E1 moves in the pivoting direction.

In the above-described embodiments, an example has been described of a case where printing is stopped if abnormality of discharge operation of the sheet S is detected, but in combination with stopping printing operation or instead of stopping printing operation, information that abnormality of discharge operation of the sheet S has been detected can be notified to the user. The notifying method can be selected arbitrarily among optional methods, such as displaying that abnormality has been detected on a liquid crystal display serving as user interface, or outputting a warning notifying that abnormality has been detected.

In the above-described embodiments, the sheet discharge apparatus 30A in which the output signals of the sensors E1 and E2 are pulse signals having mutually different periodicity has been described, but the present invention is not limited to this example. The output signals of the sensors E1 and E2 can also be pulse signals having mutually different phases. Further according to the embodiments, the sheet discharge apparatus 30C having applied the pivot disk 4 in which the slit 4*d* is formed has been described, but the present invention is not limited to this example. Instead of the pivot disk 4, a pivot disk formed without the slit formed as the slit 4*d* can be adopted. In that case, the sensor E1 will maintain the on state in a state where the flag 1 is displaced within the range of the full load detection position Pm or above and the uppermost position Pm or below, so that abnormality can be detected based on the output from a single sensor E1, similar to the pivot disk 4. Further, the observed waveform is easily recognized and detection of abnormality is facilitated.

As described, according to the present invention, even if the sheet interval is short, continuous conveyance of sheets until the number of loadable sheets P1 is reached is enabled without deteriorating productivity. Thereby, the sheet interval can be shortened compared to the prior art, and productivity can be improved even further, so that it can cope with continuous conveyance of a large amount of sheets can be realized. Even if the sheet interval is set short, abnormality can be detected by monitoring sensor signals during continuous conveyance. Thereby, for example, it becomes possible to cope with discharge failure of the sheet S caused by troubles such as malfunction of the printer 200 and abnormal state caused by the user touching the flag 1 or the sheet S being discharged.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-105567, filed May 31, 2018, which is hereby incorporated by reference herein in its entirety.

What is claimed is:

1. A sheet discharge apparatus comprising:

a sheet discharging portion configured to discharge a sheet;

a sheet supporting portion configured to support the sheet discharged from the sheet discharging portion;

a pivot member configured to pivot in an up-down direction around a pivot axis by being pressed by the sheet discharged from the sheet discharging portion, the pivot member retained by being in contact with an uppermost sheet supported on the sheet supporting portion;

a detecting unit configured to detect a position of the pivot member; and a control unit configured to change a sheet interval which is an interval between a preceding sheet and a succeeding sheet, wherein, in a state where a job in which a plurality of sheets are to be continuously discharged is received, the control unit executes a first discharge operation in which at least one sheet is discharged by the sheet discharging portion, and a second discharge operation in which sheets are discharged by the sheet discharging portion at a first sheet interval such that the pivot member does not contact with an uppermost sheet supported on the sheet supporting portion during the second discharge operation, and the control unit is configured to acquire a number of sheets to be discharged in the second discharge operation based on a detection result of the detecting unit detected during the first discharge operation.

2. The sheet discharge apparatus according to claim 1, wherein the control unit executes a third discharge operation in which at least one sheet is discharged by the sheet discharge portion at a second sheet interval that is longer than the first sheet interval, and a fourth discharge operation in which the sheet is discharged by the sheet discharging portion at a sheet interval that is shorter than the second sheet interval, and the control unit is configured to acquire a number of sheets to be discharged in the fourth discharge operation based on a detection result of the detecting unit detected during the third discharge operation.

3. The sheet discharge apparatus according to claim 2, wherein in the fourth discharge operation, the control unit controls the sheet discharging portion so as to discharge sheets at the first sheet interval.

4. The sheet discharge apparatus according to claim 1, wherein in the first discharge operation, the control unit calculates a number of sheets to be discharged in the second discharge operation based on the detection result of the detecting unit during discharge of a first sheet of the job.

5. The sheet discharge apparatus according to claim 2, wherein the detecting unit comprises a pivotal quantity detecting portion configured to detect a pivotal quantity of the pivot member and a target position detecting portion configured to detect that the pivot member is positioned at a target position, the detecting unit detecting the pivot angle of the pivot member pivoting between a position where the pivot member is retained in contact with the uppermost sheet and the target position.

6. The sheet discharge apparatus according to claim 5, wherein the target position detecting portion detects that the pivot member is positioned at a predetermined pivot range, and the target position is a position in which the target position detecting portion starts detecting the pivot member.

7. The sheet discharge apparatus according to claim 6, wherein in a case where the sheet discharging portion continuously discharges sheets in each of the second discharge operation and the fourth discharge operation, the control unit stops the sheet discharging portion if the target position detecting portion detects that the pivot member has pivoted beyond the predetermined pivot range.

8. The sheet discharge apparatus according to claim 6, wherein in the third discharge operation, the pivot member pivots to a position beyond the predetermined pivot range.

9. The sheet discharge apparatus according to claim 6, wherein the pivot member comprises a first end portion that contacts the uppermost sheet and a second end portion that is arranged on an opposite side of the first end portion interposing the pivot axis, and the target position detecting portion detects that the second end portion of the pivot member is positioned within a predetermined pivot range.

10. The sheet discharge apparatus according to claim 5, wherein the pivotal quantity detecting portion comprises a pivot disk configured to pivot around the pivot axis integrally with the pivot member and comprising a plurality of slits along a pivoting direction, a light emitting element configured to emit light, and a photosensing element configured to receive light that is emitted from the light emitting element and that has passed through any one of the plurality of slits, the pivotal quantity detecting portion outputting a pulse signal based on an on state or an off state of the photosensing element.

11. The sheet discharge apparatus according to claim 10, wherein the photosensing element comprises a first photosensing element and a second photosensing element which are configured to output pulse signals based on the pivotal quantity of the pivot member, the pulse signals output by the first photosensing element and the second photosensing element having mutually different periodicity or different phase.

12. The sheet discharge apparatus according to claim 11, wherein the plurality of slits comprises a first row of slits and a second row of slits that are arranged at different positions in a radial direction of the pivot disk, the first photosensing element receives light having passed through any one of slits of the first row, and the second photosensing element receives light having passed through any one of slits of the second row.

13. The sheet discharge apparatus according to claim 10, wherein the pivot disk comprises a wide slit having a longer width in the pivoting direction than the plurality of slits, and the target position detecting portion comprises a third light emitting element that emits light and a third photosensing element that receives the light emitted from the third light emitting element and passed through the wide slit.

14. An image forming apparatus comprising:

an image forming unit configured to form an image on a sheet;

a sheet discharging portion configured to discharge the sheet on which the image has been formed in the image forming unit;

a sheet supporting portion configured to support the sheet discharged from the sheet discharging portion;

a pivot member configured to pivot in an up-down direction around a pivot axis by being pressed by the sheet discharged from the sheet discharging portion, the pivot member retained by being in contact with an uppermost sheet supported on the sheet supporting portion;

a detecting unit configured to detect a position of the pivot member; and a control unit configured to change a sheet interval which is an interval between a preceding sheet and a succeeding sheet, wherein, in a state where a job in which a plurality of sheets are to be continuously discharged is received, the control unit executes a first discharge operation in which at least one sheet is discharged by the sheet discharging portion, and a second discharge operation in which sheets are discharged by the sheet discharging portion at a first sheet interval such that the pivot member does not contact with an uppermost sheet supported on the sheet supporting portion during the second discharge operation, and the control unit is configured to acquire a number of sheets to be discharged in the second discharge operation based on a detection result of the detecting unit detected during the first discharge operation.

15. The image forming apparatus according to claim 14, wherein the control unit executes a third discharge operation in which at least one sheet is discharged by the sheet discharge portion at a second sheet interval that is longer than the first sheet interval, and a fourth discharge operation in which the sheet is discharged by the sheet discharging portion at a sheet interval that is shorter than the second sheet interval, and the control unit is configured to acquire a number of sheets to be discharged in the fourth discharge operation based on a detection result of the detecting unit detected during the third discharge operation.

16. The image forming apparatus according to claim 15, wherein in the fourth discharge operation, the control unit controls the sheet discharging portion so as to discharge sheets at the first sheet interval.

17. The image forming apparatus according to claim 14, wherein in the first discharge operation, the control unit calculates a number of sheets to be discharged in the second discharge operation based on the detection result of the detecting unit during discharge of a first sheet of the job.

18. The image forming apparatus according to claim 15, wherein the detecting unit comprises a pivotal quantity detecting portion configured to detect a pivotal quantity of the pivot member and a target position detecting portion configured to detect that the pivot member is positioned at a target position, the detecting unit detecting the pivot angle of the pivot member pivoting between a position where the pivot member is retained in contact with the uppermost sheet and the target position.

19. The image forming apparatus according to claim 18, wherein the target position detecting portion detects that the pivot member is positioned at a predetermined pivot range, and the target position is a position in which the target position detecting portion starts detecting the pivot member.

20. The image forming apparatus according to claim 19, wherein in a case where the sheet discharging portion continuously discharges sheets in each of the second discharge operation and the fourth discharge operation, the control unit stops the sheet discharging portion if the target position detecting portion detects that the pivot member has pivoted beyond the predetermined pivot range.

21. The image forming apparatus according to claim 18, wherein the pivotal quantity detecting portion comprises a pivot disk configured to pivot around the pivot axis integrally with the pivot member and comprising a plurality of slits along a pivoting direction, a light emitting element configured to emit light, and a photosensing element configured to receive light that is emitted from the light emitting element and that has passed through any one of the plurality of slits, the pivotal quantity detecting portion outputting a pulse signal based on an on state or an off state of the photosensing element.

22. The sheet discharge apparatus according to claim 1, wherein the number of sheets, to be discharged in the second discharge operation, acquired based on the detection result of the detecting unit detected during the first discharge operation is two or more.

23. A sheet discharge apparatus comprising:

a sheet discharging portion configured to discharge a sheet;

a sheet supporting portion configured to support the sheet discharged from the sheet discharging portion;

a pivot member configured to pivot in an up-down direction around a pivot axis by being pressed by the sheet discharged from the sheet discharging portion, the pivot member retained by being in contact with an uppermost sheet supported on the sheet supporting portion;

a detecting unit configured to detect a position of the pivot member; and a control unit configured to change a sheet interval which is an interval between a preceding sheet and a succeeding sheet, wherein, in a state where a job in which a plurality of sheets are to be continuously discharged is received, the control unit executes a first discharge operation in which at least one sheet is discharged by the sheet discharging portion, a second discharge operation in which sheets are discharged by the sheet discharging portion at a first sheet interval, a third discharge operation in which at least one sheet is discharged by the sheet discharge portion at a second sheet interval that is longer than the first sheet interval, and a fourth discharge operation in which the sheet is discharged by the sheet discharging portion at a sheet interval that is shorter than the second sheet interval, and the control unit is configured to acquire a number of sheets to be discharged in the second discharge operation based on a detection result of the detecting unit detected during the first discharge operation, and a number of sheets to be discharged in the fourth discharge operation based on a detection result of the detecting unit detected during the third discharge operation.

* * * * *